US008057191B2

(12) United States Patent
Khamizov et al.

(10) Patent No.: US 8,057,191 B2
(45) Date of Patent: Nov. 15, 2011

(54) ELECTROKINETIC MICROPUMP HAVING ION-EXCHANGE MEMBRANES

(75) Inventors: Ruslan Khazhsetovich Khamizov, Moscow (RU); Muradin Abubekirovich Kumakhov, Moscow (RU); Natalia Sergeevna Bastrykina, Tambov (RU); Svetlana Vassilievna Nikitina, Moscow (RU); Alexandr Alexandrovich Voronov, Moscow (RU); Ruslan Khazhsetovich Khamizov, legal representative, Moscow (RU)

(73) Assignee: Obshschestvo S Orgranichennoj Otvetstvennostyu "Institu Rentgenovskoj Optiki", Moscow (RU)

( * ) Notice: Subject to any disclaimer, the term of this patent is extended or adjusted under 35 U.S.C. 154(b) by 553 days.

(21) Appl. No.: 11/988,372

(22) PCT Filed: Jun. 29, 2006

(86) PCT No.: PCT/IB2006/001893

§ 371 (c)(1),
(2), (4) Date: Mar. 11, 2009

(87) PCT Pub. No.: WO2007/034267

PCT Pub. Date: Mar. 29, 2007

(65) Prior Publication Data

US 2010/0034667 A1 Feb. 11, 2010

(30) Foreign Application Priority Data

Jul. 7, 2005 (RU) ..... 2005121231

(51) Int. Cl.
*H02K 44/02* (2006.01)
*F04B 35/04* (2006.01)
*F04B 37/00* (2006.01)

(52) U.S. Cl. ..... 417/48; 417/50; 204/450; 204/451; 204/454; 204/601

(58) Field of Classification Search ..... 417/48, 417/50

See application file for complete search history.

(56) References Cited

U.S. PATENT DOCUMENTS 5,279,608 A * 1/1994 Cherif Cheikh ..... 604/892.1

(Continued)

FOREIGN PATENT DOCUMENTS

RU 31859 U1 8/2003

OTHER PUBLICATIONS

Manz, A., et al., "Electroosmotic pumping and electrophoretic separations for miniaturized chemical analysis systems," J. Micromech. Microeng., 1994, p. 257-265, vol. 4, IOP Publishing Ltd.

(Continued)

*Primary Examiner* — Sikha Roy

(74) *Attorney, Agent, or Firm* — McDermott Will & Emery LLP

(57) ABSTRACT

The invention is directed to the elimination of changes of the chemical composition of a pumped liquid caused by introduction of strange components or by modification of original components. Another object of the invention is to provide the possibility of use of electrodes of the first order in order to increase productivity and decrease size and cost of the micropump.

For this purpose, the electrokinetic micropump comprises a multichannel structure 810 made of non-conducting material, for example, a piece of a polycapillary column. The inlet and outlet end of this structure are adjacent to electrode sections 803, 804 having openings 821, 822 for inlet and outlet of the pumped liquid. These sections are divided by ion-exchange membranes 811, 812 into chambers 813, 814 for flow of the pumped liquid, communicating with the ends 841, 842 of the multichannel structure, and chambers 815, 816 filled with an auxiliary medium for transfer of electric charges. In the latter electrodes 817, 818 are located. One of the membranes, namely, membrane 811, is monopolar, and its type corresponds to the polarity of the adjacent electrode 817. The other membrane, namely, membrane 812, is bipolar and faces the adjacent electrode 818 with its side that corresponds to the polarity of said electrode. On one or both sides of each ion-exchange membrane may be installed baromembranes 829, 830 for nanofiltration or reverse osmosis. As auxiliary medium may be used, in particular, the pumped liquid itself or a granulated ion-exchange material.

32 Claims, 17 Drawing Sheets

U.S. PATENT DOCUMENTS

| | | | | |
|---|---|---|---|---|
| 5,788,826 | A * | 8/1998 | Nyberg | 204/536 |
| 5,891,097 | A * | 4/1999 | Saito et al. | 604/141 |
| 7,118,671 | B2 | 10/2006 | Kumakhov et al. | |
| 7,316,543 | B2 * | 1/2008 | Goodson et al. | 417/50 |
| 7,896,867 | B2 * | 3/2011 | Gordon et al. | 604/892.1 |

OTHER PUBLICATIONS

Chen, C.-H., et al., "A Planar Electroosmotic Micropump," Journal of Microelectromechanical Systems, Dec. 2002, p. 672-683, vol. 11, No. 6, IEEE.

Geschke, O., et al., "Microsystem Engineering of Lab-on-a-chip Devices," 2004, p. 46-50, Wiley-VCH Verlag GmbH & Co. KGaA, Weinheim.

Moini, M., et al., "Hydroquinone as a Buffer Additive for Suppression of Bubbles Formed by Electrochemical Oxidation of the CE Buffer at the Outlet Electrode in Capillary Electrophoresis/Electrospray Ionization-Mass Spectrometry," Analytical Chemistry, Apr. 15, 1999, p. 1658-1661, vol. 71, No. 8, American Chemical Society.

Takamura, Y., et al., "Low-voltage electroosmosis pump for stand-alone microfluidics devices," Electrophersis, 2003, p. 185-192, vol. 24, Wiley-VCH Verlag GmbH & Co. KGaA, Weinheim.

* cited by examiner

ELECTROKINETIC MICROPUMP HAVING ION-EXCHANGE MEMBRANES

RELATED APPLICATIONS

This application is the U.S. National Phase under 35 U.S.C. §371 of International Application No. PCT/IB2006/001893, filed on Jun. 29, 2006, which in turn claims the benefit of Russian Application No. 2005 121 231, filed on Jul. 7, 2005, the disclosures of which Applications are incorporated by reference herein.

The invention relates to a means for pumping small amounts of liquid, more specifically to micropumps that do not contain moving solid parts, namely, to micropumps based on the use of electrokinetic effect.

Known are electrokinetic (electroosmotic) micropumps [1-4] employing the effect of formation of a electric double layer on the polar liquid-solid dielectric interface. On imposition of an external electric field on highly porous bodies that are in contact with a polar liquid and possess a developed contact surface, a small shift of the mobile (diffuse) part of the electric double layer takes place relative to its stationary (wall) part, resulting in a forced displacement of the liquid parallel to the external electric field. Such micropumps have a number of restrictions, the most important one being electrolysis of the pumped solution, which may cause changes in the chemical composition of the latter. Another drawback of the known micropumps consists in the formation of gas bubbles in direct contact with the porous body, which may result in a deterioration or even termination of the pumping of the liquid [4].

These drawbacks are eliminated in an electrokinetic micropump [5] utilizing two porous bodies with oppositely charged pore surfaces, with one of the porous bodies operating for pumping of the liquid from the cathode to the anode, and the other for pumping from the anode to the cathode. At that, to each of the porous bodies is adjacent only one of the electrodes on the outer side of micropump, the porous bodies being connected in such a way that they would create a common flow inside the micropump. The drawbacks of this device consist in the difficulties in selecting the porous materials or in modifying their surface, as well as in the high cost of the device. This known micropump requires also utilization of electrodes of the second order and salt bridges in order to eliminate completely the possibility of blocking the pumping of the liquid by gas bubbles, as well as to prevent modification of the chemical composition of the pumped liquid due to electrolysis. These measures, in turn, restrict the possibility of developing compact devices.

Said drawbacks are also overcome in an electrokinetic micropump [6] which is operated with microquantities of a buffer substance (for example, hydroquinone) being added to the pumped liquid, the buffer substance being characterized by low redox potential values and the ability to inhibit electrolytic decomposition of water or other gas-forming components on the electrodes. However, the drawback of this device lies in the necessity of "contamination" of the pumped liquid with buffer substance.

A micropump which is free of said drawbacks is described in [7]. This micropump utilizes as an electrode a conductive polymeric gel that is in contact with metal platinum. In this device, instead of gas formation due to electrolysis, chemical rearrangement of the organic substances in the polymeric gel occurs. The drawback of this device consists in that the current density that can be obtained with said electrodes is so low that the device may be used only for chemical analysis purposes employing analytical microchips.

Another electrokinetic micropump which is free of said drawbacks is described in patent [8]. The device comprises a hollow cylindrical housing made of a non-conducting material. In the housing an anodic and a cathodic electrode are mounted that are connected to a DC power source. A highly porous ceramic body with a developed inner surface is situated between the electrodes. Between either of the electrodes and the highly porous body a cation-exchange membrane is placed that is immediately adjacent to the respective electrode. In the wall of the housing channels for the flow of the pumped liquid are made that extend between the ends of the highly porous body and the cation-exchange membranes. Both electrodes are silver-silver chloride electrodes.

This electrokinetic micropump that made on the basis of a multichannel structure, namely, the highly porous ceramic body, is closest to the micropump according to the invention.

However, this known device has a number of drawbacks.

The use of monopolar membranes of the same type (for example, cation-exchange membranes) along with the anodic and cathodic electrodes does not protect the pumped liquid from ionic impurities, among such impurities being those that get into said liquid from the electrodes. This is due to the fact that any electrochemical system comprising a pair of identical ion-exchange membranes between cathode and anode, independently of the type of electrode used, is always permeable to ions with a certain charge moving towards one of the electrodes. In case of cation-exchange membranes the system is permeable for cations moving towards the cathode.

Said known device employs also electrodes of the second order, namely, silver-silver chloride electrodes that serve to prevent electrolysis processes. However, in view of the above, use of such electrodes results in a continuous formation of ionic components of the electrode system even in the absence of electrolysis in the pumped liquid, and these ionic components are introduced into the pumped liquid. In particular, in case of silver-silver chloride electrodes, silver ions are permanently formed on the anodic electrode and are transferred to the cathodic electrode, as well as chlorine ions are permanently formed on the cathodic electrode. Additionally, in the area between the cathodic electrode and its adjacent cation-exchange membrane a poorly soluble compound forms, namely, silver chloride which is in the form of crystals. These must be continuously removed in order to maintain constant performance characteristics of the micropump. Additionally, after silver ions getting into the pumped liquid through the cation-exchange membrane adjacent to the anodic electrode, all cationic components of the pumped liquid, in addition to silver ions, may take part in further cations transfer to the cathodic electrode, for example, hydrogen ions from water. Furthermore, silver hydroxide and silver(II) oxide and other compounds might form in the pumped liquid, resulting not only in chemical contamination of the pumped liquid, but possibly also blocking the functioning of the micropump by plugging up the multichannel structure.

An attempt to avoid the use of electrodes of the second order and to replace them by electrodes of the first order in known micropump could not be successful, because in this case also two identical monopolar membranes would not protect the pumped medium from all the ionic impurities. Additionally, problems would arise associated with electrolysis processes in the pumped liquid.

Furthermore, use of silver-silver chloride electrodes, just like the use of any other electrodes of the second order, results in a reduction of the allowable current density and, as a consequence, decrease in the pump productivity (electrodes of the second order are usually employed for purposes of analysis and not for the supply of electric energy). Therefore, to achieve the same productivity the size of the micropump must be increased, leading also to a higher cost.

It is an object of the invention to achieve a technical result consisting in avoiding changes in the chemical composition of the pumped liquid due to introduction of foreign components, or modification of the original components of said liquid. The technical result that is achieved by the invention consists also in providing the possibility of employing electrodes of the first order in order to increase productivity and decrease size and cost of the micropump.

Further technical results will become evident from the following description of the characterizing features of the invention and its various embodiments.

In order to achieve the above technical result the electrokinetic micropump according to the invention comprises a multichannel structure made of non-conducting material with through microchannels. The inlets and outlets of the microchannels form the inlet and outlet ends of the multichannel structure. Either end of the multichannel structure is adjacent to an electrode section. One of the electrode sections contains an anodic electrode, and the other a cathodic electrode. The anodic and cathodic electrodes are designed for connection to corresponding poles of an external current source. In either electrode section a ion-exchange membrane is mounted between the electrode that is placed inside the electrode section and the end of the multichannel structure. The ion-exchange membranes divide each of the electrode sections into two chambers. The chambers on one side of either ion-exchange membrane communicate with the end of the multichannel structure, and the chambers located on the other side of either ion-exchange membrane contain said anodic and cathodic electrodes. The chambers of both electrode sections that communicate with the end of the multichannel structure are designed for flow of the pumped liquid. One of these chambers has an inlet channel, and the other one has an outlet channel for the pumped liquid. The chambers that contain the anodic and cathodic electrodes are designed for being filled with an auxiliary medium for transfer of the electric charges. One of said ion-exchange membranes is monopolar, and the other is bipolar. The type of the monopolar ion-exchange membranes corresponds to the polarity of the nearest electrode, and the bipolar ion-exchange membrane is facing the nearest electrode with its side that corresponds to the polarity of this electrode.

In other words, if the monopolar ion-exchange membrane is an anion-exchange membrane, then it should be placed in the electrode section containing the anodic electrode. In this case the bipolar ion-exchange membrane should be mounted in the electrode section containing the cathodic electrode, facing it with its cation-exchanging side. Accordingly, if the monopolar ion-exchange membrane is a cation-exchange membrane, then it should be installed in the electrode section containing the cathodic electrode. In this case, the bipolar ion-exchange membrane should be mounted in the electrode section containing the anodic electrode, facing it with its anion-exchanging side.

The electrokinetic micropump according to the present invention and the closest prior art micropump according to patent [8] both have in common a multichannel structure which is located between the anodic and the cathodic electrodes and serves for connection to an external current source, ion-exchange membranes which are placed between said electrodes and the ends of the multichannel structure, as well as inlet channels and outlet channels for the pumped liquid that flows in the spaces between the ends of the multichannel structure and the ion-exchange membranes.

Unlike the known micropump of closest prior art using identical ion-exchange membranes (namely, monopolar membranes, both being cation-exchange membranes), in the electrokinetic micropump of the present invention the ion-exchange membranes that are mounted between the ends of the multichannel structure and the electrodes are different from each other, with one of them not being monopolar, but bipolar, and the type of the other (monopolar) ion-exchange membrane being determined by the polarity of the nearest electrode. Therefore, different to the known micropump according to [8], a cation-exchange membrane may never be installed near an anodic electrode. Another characterizing feature, along with the presence of a bipolar ion-exchange membrane, is that this membrane should be orientated in a certain way, namely, facing the nearest electrode with its side corresponding to the polarity of this electrode. The anodic and the cathodic electrodes are arranged in structural elements of the electrokinetic micropump of the present invention that are adjacent to the ends of the multichannel structure and constitute the electrode sections. Either electrode section is divided by a monopolar or bipolar ion-exchange membrane into two chambers. One chamber of each of said sections is adjacent to the end of the multichannel structure. This chamber is used for passage of the pumped liquid and has a channel for inlet (outlet) of the pumped liquid. On the other side of the respective ion-exchange membrane, a second chamber is situated in each electrode section. The chambers in both electrode sections are formed due to the fact that, as distinct from the known device mentioned above, the ion-exchange membranes are installed not closely to the electrodes. These chambers are designed for being filled with an auxiliary medium, during the operation of the micropump serving for transfer of electric charges between the electrode and the ion-exchange membrane that is nearest to it.

The use of a pair of different ion-exchange membranes, namely, a monopolar and a bipolar membrane, under the condition that the cation-exchange membrane (or cationite side of the bipolar membrane) is adjacent to the cathodic electrode, and the anion-exchange membrane (or anionite side of the bipolar membrane) is adjacent to the anodic electrode, taking also into consideration that the bipolar membrane is designed not for the transfer of ions, but only for the decomposition of water into hydrogen ions and hydroxyl ions, makes it possible to completely seperate the processes that take place near the electrodes from the processes that take place in the multichannel structure, except for the balanced transfer of said hydrogen ions and hydroxyl ions, maintaining so the electrical neutrality of the medium. This allows to eliminate the possibility of contamination of the pumped liquid.

The use of such a membrane system together with a structural feature consisting in the presence of a chamber for an auxiliary medium between the ion-exchange membranes and the respective electrode, the auxiliary medium ensuring charge transfer in the electrode section and removal or neutralization of electrolysis products, allows also to eliminate the possibility of changes of the chemical composition of the pumped liquid.

Additionally, this feature makes possible to use simple electrodes of the first order having a high allowable current density for increasing the productivity of the micropump and reducing its size and cost.

Said selection of a combination of ion-exchange membranes and their arrangement relative to the electrodes provides for the possibility of pumping liquids having excess positive or negative charge in the electric double layer in the direction from the anodic to the cathodic electrode section or in the opposite direction, depending on the whether said excess charge is positive or negative.

The multichannel structure may be a highly porous body, like in the closest prior art electrokinetic micropump according to patent [8]. However, the micropump according to the invention preferably comprises a multichannel structure in the form of a piece of a polycapillary column made of non-conducting material with end-to-end capillaries forming a plurality of parallel microchannels.

This embodiment of the multichannel structure ensures the highest productivity of the micropump, with the other conditions being equal, because in case of parallel channels the sum of the electrical fields formed by the electric double layers in each channel has the maximum absolute value. Additionally, the capillary column provides for a smaller spread of the transverse dimensions and the length of the channels in comparison with highly porous body, which also positively tells on the productivity of the micropump.

The micropump according to the invention may further comprise baromembranes for nanofiltration or reverse osmosis that are placed on one side or on both sides of each of said ion-exchange membranes.

The use of baromembranes promotes an increase in efficiency of pumping liquids that contain solutions of electrolytes, allows to prevent ionic components of the auxiliary medium from reaching the ion-exchange membranes, and prevents a chemical "poisoning" of the latter.

The auxiliary medium for transfer of charges may be, in particular, a liquid that is identical to the pumped liquid.

This provides for simplicity of the operation of the device.

The auxiliary medium for transfer of electric charges may also be a solution, suspension or paste of a mixture of substances comprising at least one chemical element at different oxidation levels.

Such a composition of the auxiliary medium for transfer of electric charges allows to prevent processes of gas evolution on the anodic and the cathodic electrode. Additionally, in the latter cases, i.e., when this medium is in the form of a suspension or a paste, the efficiency of the auxiliary medium for transfer of electric charges is greater.

The auxiliary medium for transfer of electric charges may also be a solution of at least one electrolyte containing an element that is present in the material of the corresponding electrode.

This embodiment is appropriate for the prevention of the formation of gaseous products in the chamber filled with the auxiliary medium for transfer of electric charges in which the cathodic electrode is placed.

Further, the auxiliary medium for transfer of electric charges may be a granulated ion-exchange material.

This embodiment allows to prevent ionic solutes, as well as gas bubbles, from invading the pumped liquid.

The described types of auxiliary medium for transfer of electric charges may be used both in micropumps containing no baromembranes for nanofiltration or reverse osmosis, and in micropumps containing baromembranes, and can be combined with any of the above-mentioned specific cases of their arrangement.

With any of the above-mentioned types of auxiliary medium for transfer of electric charges the anodic electrode may be made of material insoluble in this medium under the action of a positive electric potential.

This embodiment allows to use the anodic electrode for a long time with no change of its properties occurring.

If the auxiliary medium for transfer of electric charges is a granulated ion-exchange material, the anodic electrode may also be made of a material soluble in this medium under the action of a positive electric potential.

This is suitable for prevention of the formation of gaseous products in the chamber filled with the auxiliary medium for transfer of electric charges, in which the anodic electrode is located.

If a granulated ion-exchange material or a solution of at least one electrolyte containing an element that is also present in the material of the cathodic electrode is used as auxiliary medium for transfer of electric charges, the cathodic electrode may be made of a material on which components of the auxiliary medium for transfer of electric charges will deposit under exposure to a negative electric potential.

This embodiment is suitable for the prevention of generation of gaseous products in the chamber filled with the auxiliary medium for transfer of electric charges, in which the cathodic electrode is located.

The invention is illustrated by the drawings.

Figure 1:
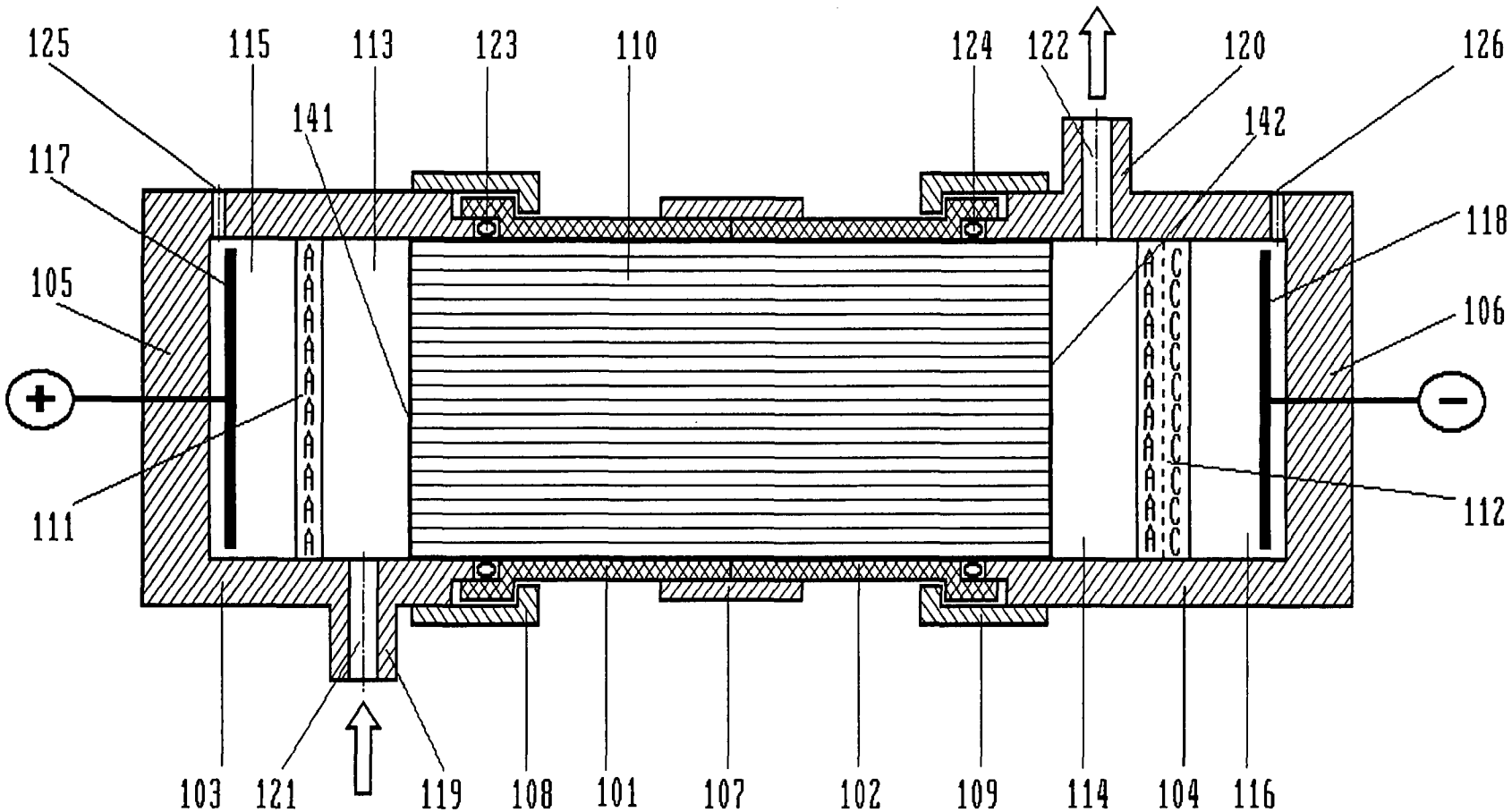
FIG. 1 and FIG. 2 show exemplary embodiments of an electrokinetic micropump for pumping liquids that form an excessive positive or negative charge in the electric double layer, with the chamber for the auxiliary medium being filled with a liquid that is identical to the pumped liquid, and with a multichannel structure in the form of a piece of a polycapillary column.

In the embodiment according to FIG. 1 the electrokinetic micropump of the present invention has a cylindrical hollow housing comprising two tubular parts 101, 102 that are connected with each other, and two cylindrical electrode sections, namely, the anodic section 103 and the cathodic section 104, closed to the outside by end walls (105 resp. 106). The tubular parts 101, 102 of the housing are connected to one another by means of a sleeve 107, and to the anodic 103 and cathodic 104 section by means of coupling nuts 108, 109.

All said elements of the housing and both sections are made of a non-conducting material, for example, plastic. Suitable plastics may include polyethylene, polypropylene, polyvinylchloride, polystyrene, Plexiglas, polyamides, polyimides, polycarbonates, etc.

In the housing the multichannel structure is mounted in the form of a piece of a polycapillary column 110 made of glass, quartz or an other dielectric material. The polycapillary column comprises hundreds of thousands of parallel end-to-end capillaries (microchannels) of identical size, the cross section ranging from one micron up to hundreds of microns.

In the anodic 103 and cathodic 104 sections the anodic electrodes 117 and the cathodic electrodes 118, respectively, are mounted, as well as a monopolar ion-exchange membrane 111 and a bipolar ion-exchange membrane 112. The connection of the anodic and the cathodic electrode to the corresponding poles of an elecrtical current source is indicated in FIG. 1 and the other figures by the symbols "+" and "−". In the corresponding sections the membranes 111, 112 form partitions, dividing each of these sections into two chambers. The spaces between each of the ion-exchange membranes and the inlet end 141 resp. outlet end 142 of the piece of polycapillary column 110 that is closest to the respective membrane constitute the chambers (113, 114) for flow of the pumped liquid, and the space between each of the ion-exchange membranes and the end wall (105, 106) of the anodic section 103 resp. cathodic section 104 that is closest to the respective membrane constitute the chambers (115, 116) that are filled with an auxiliary medium for transfer of electric charges. The anodic 117 and cathodic 118 electrode are arranged in the chambers 115, 116 that are filled with the auxiliary medium for transfer of electric charges. In this case the monopolar ion-exchange membrane 111 is an anion-exchange membrane, and the bipolar ion-exchange membrane 112 is facing the cathodic electrode 118 with its cationite side (anionite membranes and anionite sides of bipolar membranes in FIG. 1 and subsequent figures are indicated by the repetitive symbol "A", and cationite sides of bipolar membranes are indicated by the repetitive symbol "C"). The anodic electrode 117 is made of a material that is insoluble in the auxiliary medium for transfer of electric charges under exposure to a n anodic potential, for example, of platinum or graphite.

The anodic 103 and the cathodic 104 section are equipped with nipples 119, 120 that are placed on the side of the chambers 113, 114 for flow of the pumped liquid. Axial through openings 121, 122 of the nipples define channels for inlet resp. outlet of the pumped liquid (direction of liquid movement is indicated by arrows). The piece of polycapillary column 110 is inserted in such a way that it would not block the openings 121, 122 of the nipples 119, 120. On the side of chambers 115, 116 that are filled with auxiliary medium for transfer of electric charges the anodic 103 and cathodic 104 section are provided with holes 125, 126 for the outlet of gases.

The ends of the tubular parts 101, 102 of the housing and the adjacent ends of the anodic 103 and cathodic 104 section are made with a configuration guaranteeing their matching when joined together. Rubber or silicone sealing rings 123, 124 that fit tightly on the piece of polycapillary column 110 and are mounted in the area of joining the tubular parts 101, 102 of the housing to the anodic 103 and cathodic 104 section serve for ensuring hermiticity of the device and preventing leakage from the piece of polycapillary column.

There are no spaces between the membranes 111, 112 and the walls of the anodic 103 and the cathodic 104 section. This prevents leakages between neighboring chambers that are divided by each of these membranes, except for molecular water transfer and anions transfer through the anionite membrane 111.

The multichannel polycapillary structure which according to the embodiment described above and to other embodiments is in the form of a piece of polycapillary column, may be prepared, for example, by means of the techniques described in patents [9-11]. It is also possible to use the process described in patent [12], which is used for the production of polycapillary chromatographic columns. This process is preferred because it guarantees a small spread of the transverse dimensions of the microchannels, and with the other conditions being equal, a decrease of the spread has a positive effect on the productivity of the micropump. This is due to the pressure at the outlet of thinner individual microchannels of the multichannel structure being higher than would be the pressure at the outlet of wider microchannels. Equalization of the total pressure on the outlet end of the multichannel structure is associated with the formation of microscopic counterflows and the decrease of the rate of pumping through wider individual channels.

Figure 2:
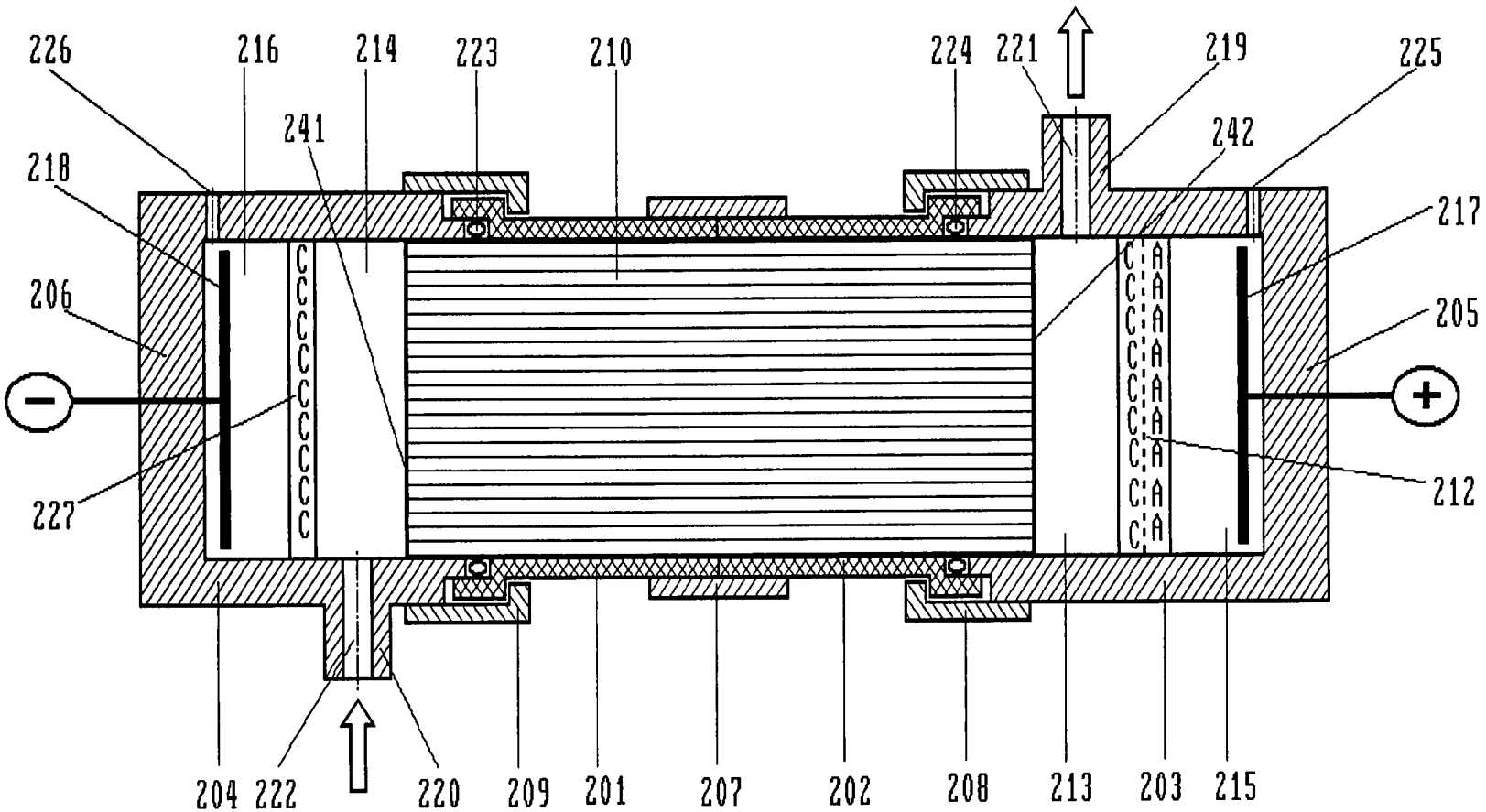

The electrokinetic micropump that shown in cross section in FIG. 2 is similar to the micropump shown in FIG. 1, except for a cationite ion-exchange membrane 227 being mounted in the cathodic section 204 and the bipolar ion-exchange membrane 212 being mounted in the anodic section 203 in such a way that its anionite side faces the anodic electrode 217. For indication of cationite membranes in this and following figures the repetitive symbol "C" is used.

Beside those mentioned above, in FIG. 2 the following reference numbers are used:

- 201, 202—tubular parts of the housing;
- 205, 206—end walls of the anodic and the cathodic section;
- 207—sleeve for connection of the tubular parts of the housing;
- 208, 209—coupling nuts for connection of the tubular parts of the housing with the anodic and the cathodic section;
- 210—multichannel structure in the form of a piece of a polycapillary column;
- 213, 214—chambers for flow of the pumped liquid;
- 215, 216—chambers filled with auxiliary medium for transfer of electric charges;
- 218—cathodic electrode;
- 219, 220—nipples (outlet resp. inlet);
- 221, 222—openings of the nipples for outlet resp. inlet of the pumped liquid;
- 223, 224—annular sealing pads;
- 225, 226—holes in the walls of anodic resp. cathodic section for the outlet of gases;
- 241, 242—inlet resp. outlet end of the multichannel structure.

The auxiliary medium used to fill chambers 115, 116 and 215, 216 of micropumps according to FIG. 1 and FIG. 2, is a liquid identical to the pumped liquid.

Figure 3:
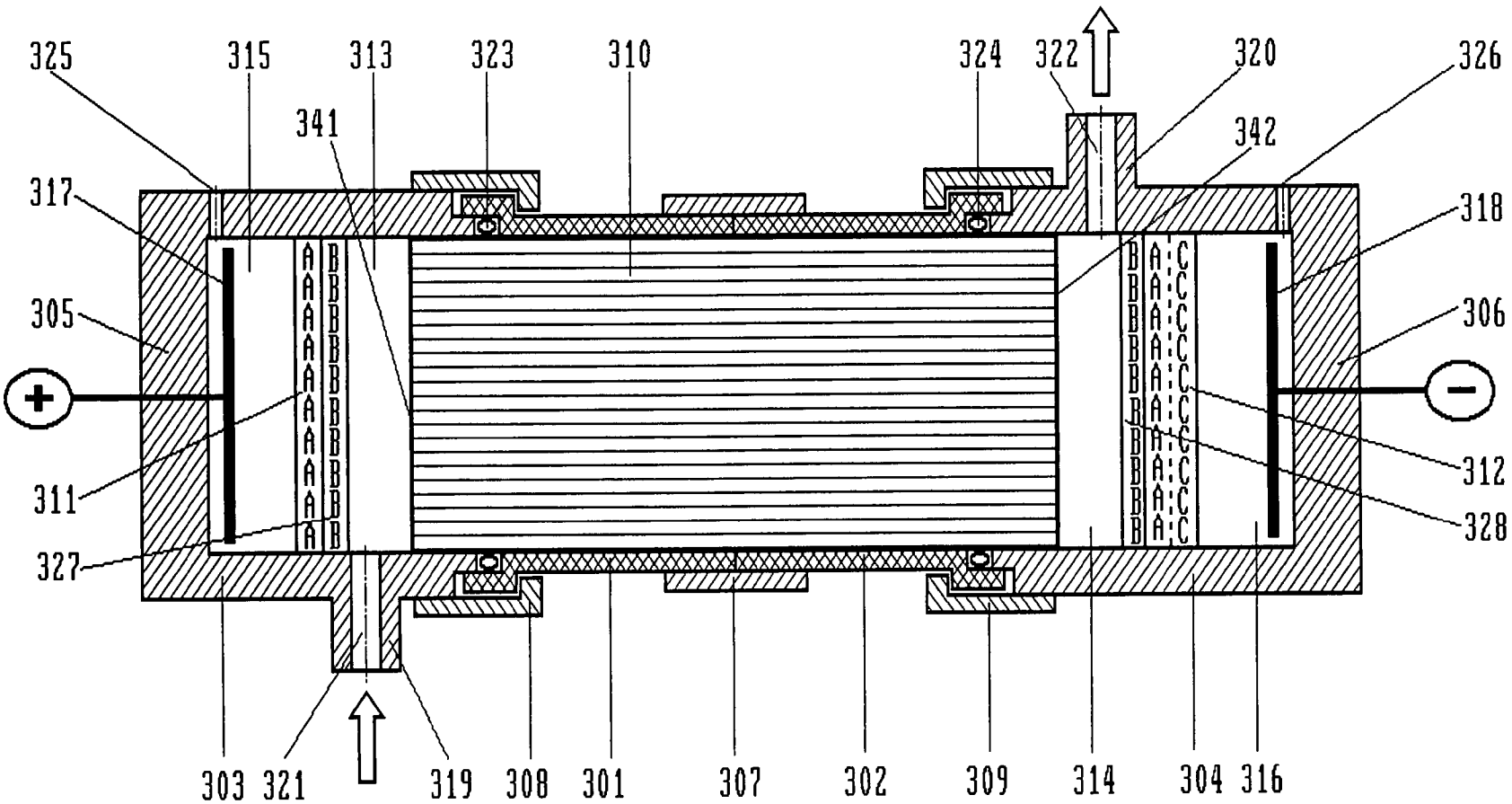
FIG. 3 shows the embodiment of the electrokinetic micropump according to FIG. 2, further comprising baromembranes for nanofiltration or reverse osmosis located on the sides of ion-exchange membranes that face the ends of the piece of a polycapillary column.

The electrokinetic micropump shown in cross section in FIG. 3 is similar to the micropumps shown in FIG. 1 and FIG. 2, except for baromembranes 327, 328 for nanofiltration and reverse osmosis being additionally mounted in the anodic section 303 and the cathodic section 304. To indicate a baromembrane in this Figure and the following Figures the repetitive symbol "B" is used. Said baromembranes are adjacent to the side of the ion-exchange membranes 311, 312 that is nearest to the chambers 313, 314 for flow of the pumped liquid.

Beside those specified above, in FIG. 3 the following reference numbers are used:

301, 302—tubular parts of the housing;
305, 306—end walls of the anodic and the cathodic section;
307—sleeve for connection of the tubular parts of the housing;
308, 309—coupling nuts for connection of the tubular parts of the housing with the anodic and the cathodic section;
310—multichannel structure in the form of a piece of a polycapillary column;
315, 316—chambers filled with auxiliary medium for transfer of electric charges;
317, 318—anodic resp. cathodic electrode;
319, 320—nipples (inlet resp. outlet);
321, 322—openings of the nipples for inlet resp. outlet of the pumped liquid;
323, 324—annular sealing pads;
325, 326—holes for outlet of gases in the walls of the anodic resp. cathodic section;
341, 342—inlet resp. outlet end of the multichannel structure.

In the micropump according to FIG. 3, similar to the micropumps according to the two preceding Figures, a liquid identical to the pumped liquid is used as the auxiliary medium for transfer of electric charges. The chambers 315, 316 are filled with it.

Figure 4:
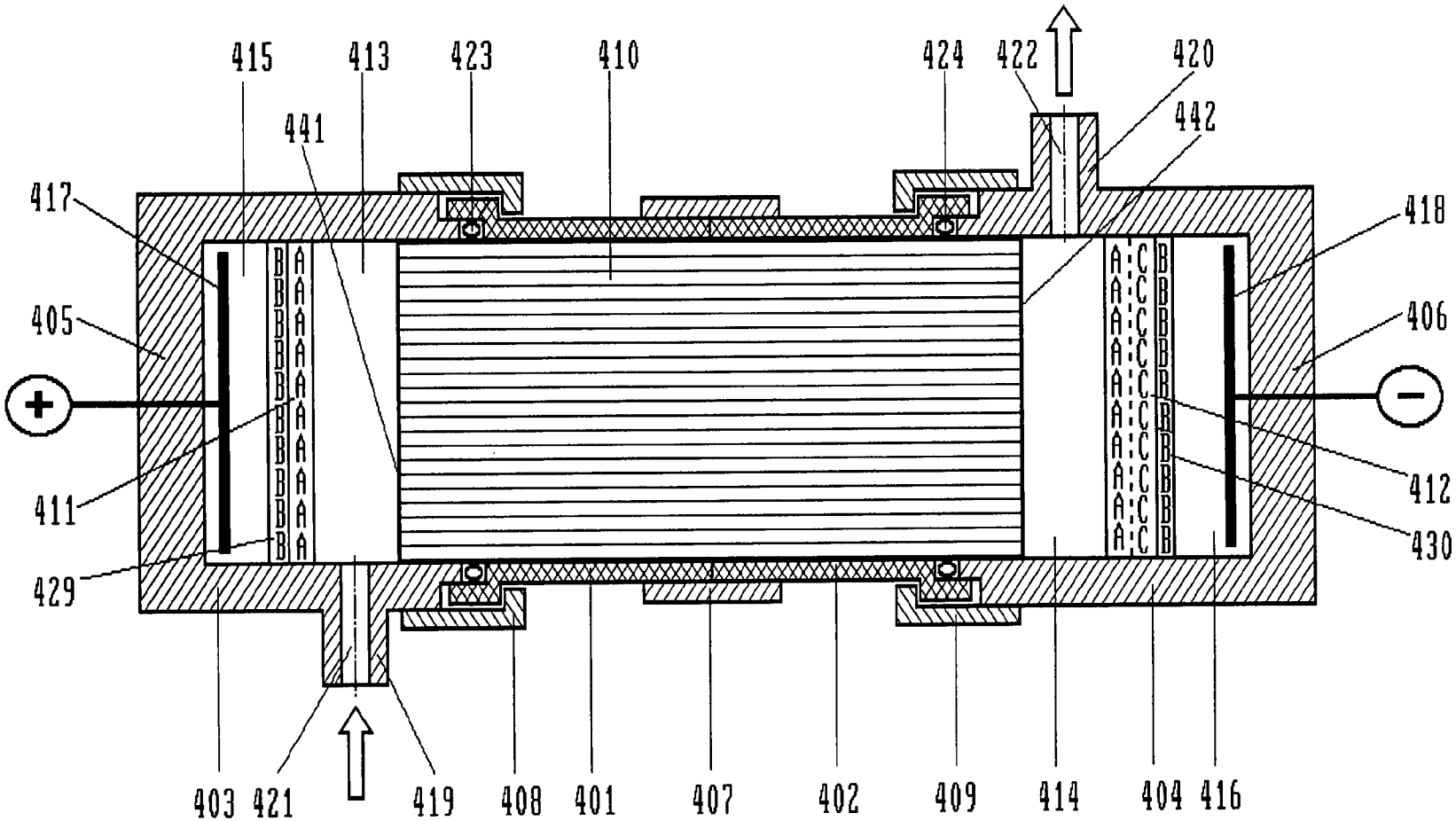
FIG. 4 shows the embodiment of the electrokinetic micropump according to FIG. 2, further comprising baromembranes for nanofiltration or reverse osmosis located on the sides of ion-exchange membranes that face the corresponding electrodes.

The special feature of the embodiment of the electrokinetic micropump shown in FIG. 4 consists in the chambers 415, 416 that are filled with an auxiliary medium for transfer of electric charges and are located in the anodic 403 and the cathodic 404 section being hermetic and having no openings for the outlet of gases. The baromembranes 429, 430 are adjacent to the ion-exchange membranes 411 (anion-exchange) and 412 (bipolar) on the side facing said chambers 415, 416.

Beside those specified above, in FIG. 4 the following reference numbers are used:

401, 402—tubular parts of the housing;
405, 406—end walls of the anodic and cathodic section;
407—sleeve for connection of the tubular parts of the housing;
408, 409—coupling nuts for connection of the tubular parts of the housing with the anodic and the cathodic section;
410—multichannel structure in the form of a piece of a polycapillary column;
413, 414—chambers for flow of the pumped liquid;
417, 418—anodic resp. cathodic electrode;
419, 420—nipples (inlet resp. outlet);
421, 422—openings of nipples for inlet resp. outlet of the pumped liquid;
423, 424—annular sealing pads;
441, 442—inlet resp. outlet end of the multichannel structure.

In the micropump shown in FIG. 4, a solution of a mixture of substances containing at least one chemical element at different oxidation levels may be used as the auxiliary medium for transfer of electric charges. For example, the auxiliary medium may be an acid solution of a mixture of ferric and ferrous iron or a basic solution of a mixture of potassium permanganate and potassium manganate.

In the micropump shown in FIG. 4 also a suspension or paste of a mixture of substances containing at least one chemical element at different oxidation levels can be used as auxiliary medium for transfer of electric charges. For example, the auxiliary medium may be a mixture of ferrous and ferric salts, cobaltous and cobaltic salts, a mixture of potassium permanganate and potassium manganate, a mixture of potassium permanganate and manganese dioxide, a mixture of potassium manganate and manganese dioxide, a mixture of chromium salts in different oxidation forms, etc.

In all embodiments of the electrokinetic micropump according to FIG. 4 the special feature of the auxiliary medium for transfer of electric charges in chamber 415 of the anodic section 403 consists in an excess content of an element in reduced form in a mixture of compounds of one element at different oxidation levels.

In all embodiments of the electrokinetic micropump according to FIG. 4 the special feature of the auxiliary medium for transfer of electric charges in chamber 416 of the cathodic section 404 consists in an excess content of a compound of an element in oxidized form in a mixture of compounds of one element at different oxidation levels.

Thus, the auxiliary medium for transfer of electric charges in both chambers 415, 416 in all these cases meets the same condition: it comprises a mixture of substances containing at least one chemical element at different oxidation levels.

Figure 5:
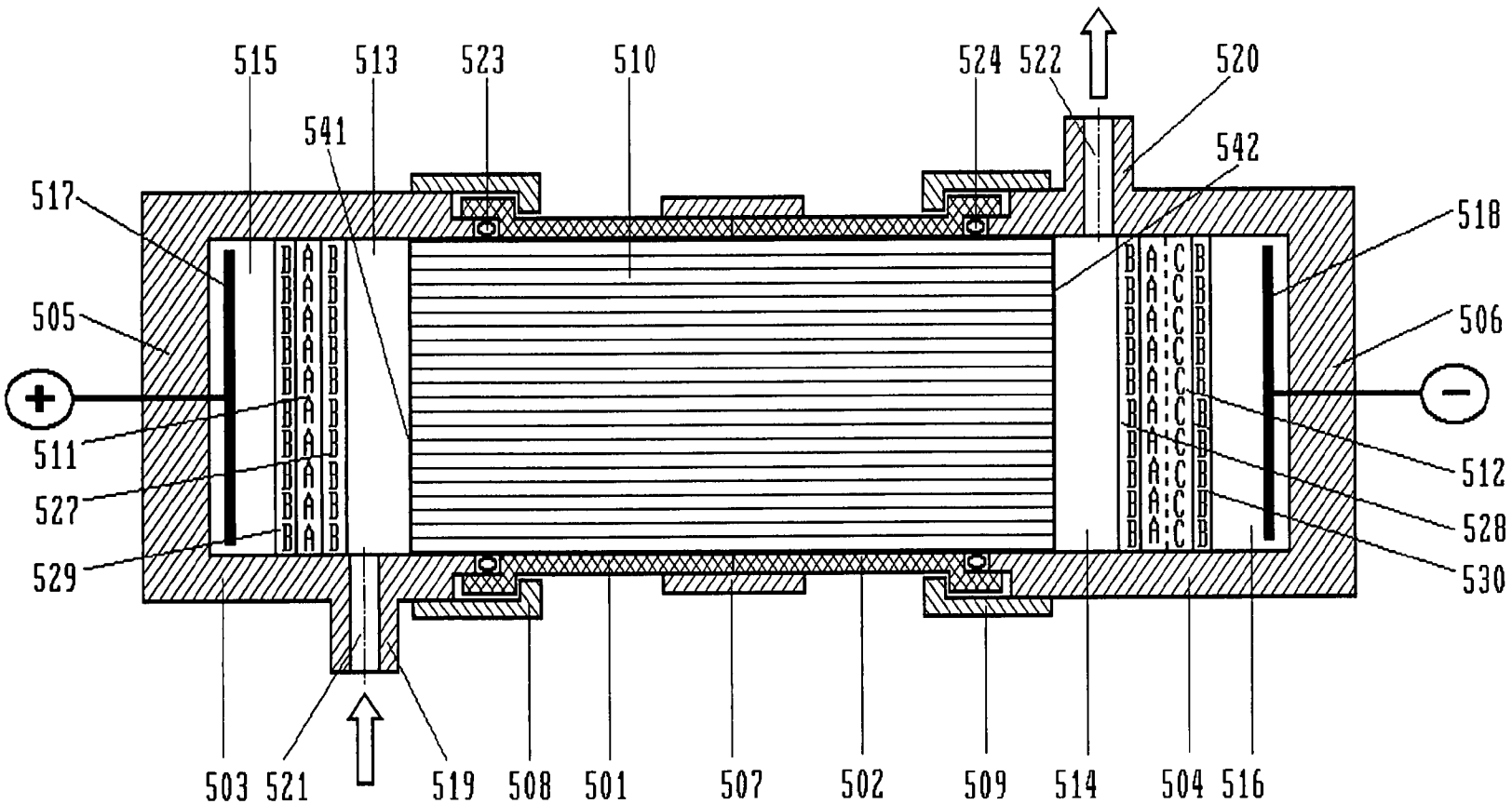
FIG. 5 shows the embodiment of the electrokinetic micropump according to FIG. 2, further comprising baromembranes for nanofiltration or reverse osmosis located on both sides of the ion-exchange membranes.

The electrokinetic micropump shown in cross section in FIG. 5 is similar to the micropump shown in FIG. 4, except for two baromembranes being placed into each of the anodic 503 and the cathodic 504 section (527, 529 resp. 528, 530), adjacent to ion-exchange membranes 511 (anionite) and 512 (bipolar) on both sides.

Beside those specified above, in FIG. 5 the following reference numbers are used:

501, 502—tubular parts of the housing;
505, 506—end walls of the anodic and the cathodic section;
507—sleeve for connection of the tubular parts of the housing;
508, 509—coupling nuts for connection of the tubular parts of the housing with the anodic and the cathodic section;
510—multichannel structure in the form of a piece of a polycapillary column;
513, 514—chambers for flow of the pumped liquid;
515, 516—chambers filled with auxiliary medium for transfer of electric charges;
517, 518—anodic resp. cathodic electrode;
519, 520—nipples (inlet resp. outlet);
521, 522—openings of the nipples for inlet resp. outlet of the pumped liquid;
523, 524—annular sealing pads;
541, 542—inlet resp. outlet end of the multichannel structure.

Figure 6:
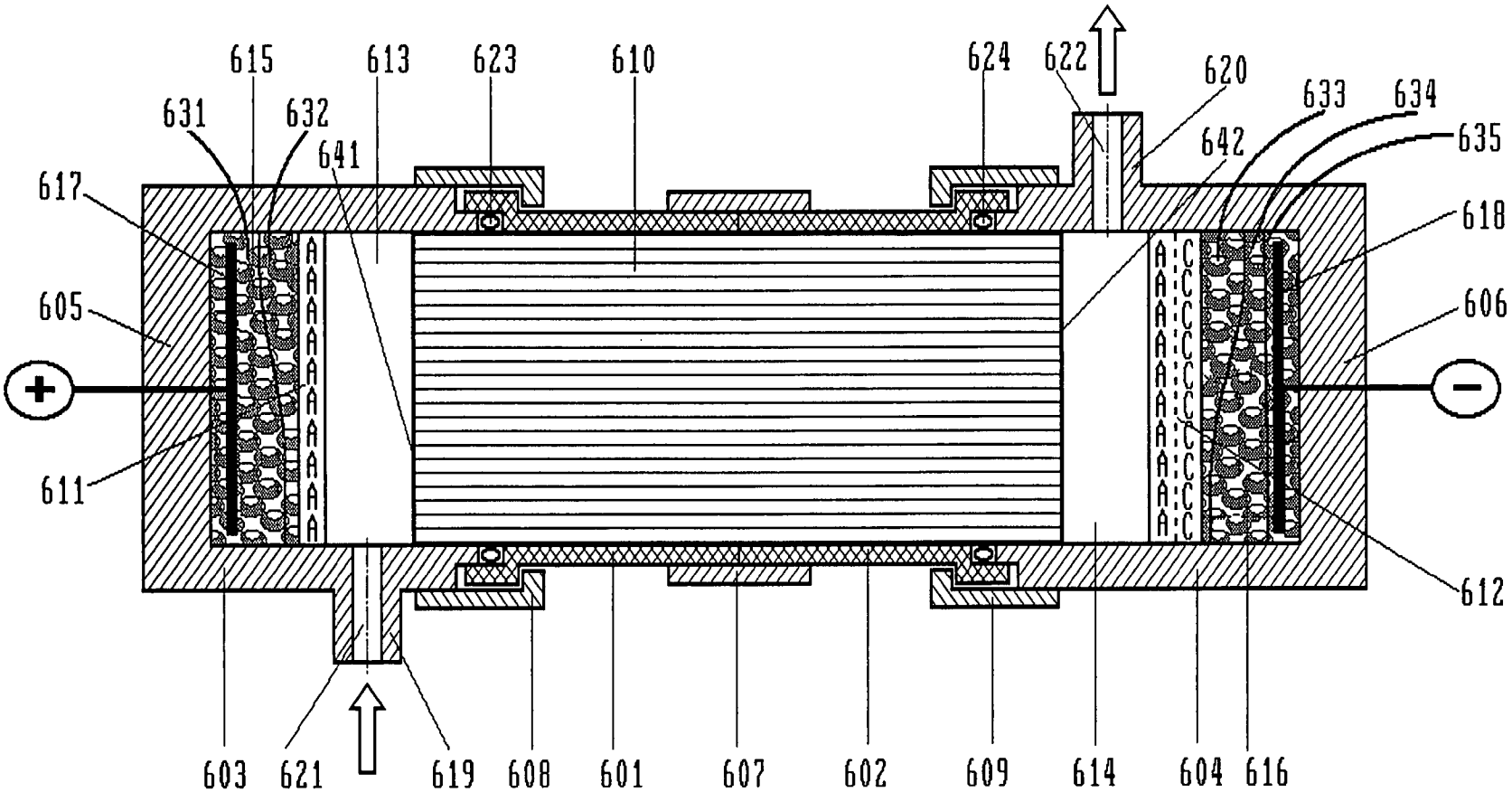
FIG. 6 shows an embodiment of the electrokinetic micropump with granulated ion-exchange material used as auxiliary medium for transfer of electric charges.

The embodiment of the electrokinetic micropump shown in cross section in FIG. 6 is close to that of the micropump shown in FIG. 4, but it has following features:

it comprises no baromembranes;
granulated ion-exchange material is used as the auxiliary medium for transfer of electric charges that is filled into the chambers 615, 616 of the anodic 603 and the cathodic 604 section;
the anodic electrode 617 is made of material that is soluble in the auxiliary medium for transfer of electric charges under the action of a positive electric potential;

the cathodic electrode 618 is made of a material on which components of the auxiliary medium for transfer of electric charges deposit under the action of a negative electric potential.

Beside those specified above, in FIG. 6 the following reference numbers are used:

601, 602—tubular parts of the housing;
605, 606—end walls of the anodic and the cathodic section;
607—connecting sleeve for the tubular parts of the housing;
608, 609—coupling nuts for connection of the tubular parts of the housing with the anodic and the cathodic section;
610—multichannel structure in the form of a piece of a polycapillary column;
611, 612—anionite resp. bipolar ion-exchange membranes;
613, 614—chambers for flow of the pumped liquid;
619, 620—nipples (inlet resp. outlet, correspondingly);
621, 622—openings of the nipples for inlet resp. outlet of the pumped liquid;
623, 624—annular sealing pads;
631, 632 and 633, 634, 635—layers of granulated ion-exchange material used as the auxiliary medium for transfer of electric charges that fills the corresponding chambers of the anodic and the cathodic section (see below for details);
641, 642—inlet resp. outlet end of the multichannel structure.

As granulated ion-exchange material in the micropump shown in FIG. 6 may be used, for example, a cationite, in particular, sulfonic cationite, carboxylic or phosphonic acid cationite, and as material for the anodic and the cathodic electrode may be used metals having a good conductivity, for example, copper, silver, zinc, nickel, etc. The cationite forms several layers in the chambers that are filled with the auxiliary medium for transfer of electric charge. The layer 631 of cationite that is adjacent to the anodic electrode 617 in chamber 615 of the anodic section 603, as well as the middle layer 634 in chamber 616 of the cathodic section 604 comprise cationite in the corresponding metal form. The layer 632 of cationite in chamber 615 of the anodic section 604, adjacent to anionite ion-exchange membrane 611, as well as the peripheral layers 633 and 635 in chamber 616 of the cathodic section 604, adjacent to the bipolar ion-exchange membrane 612 resp. to the cathodic electrode 618, are cationite in hydrogen form.

Figure 7:
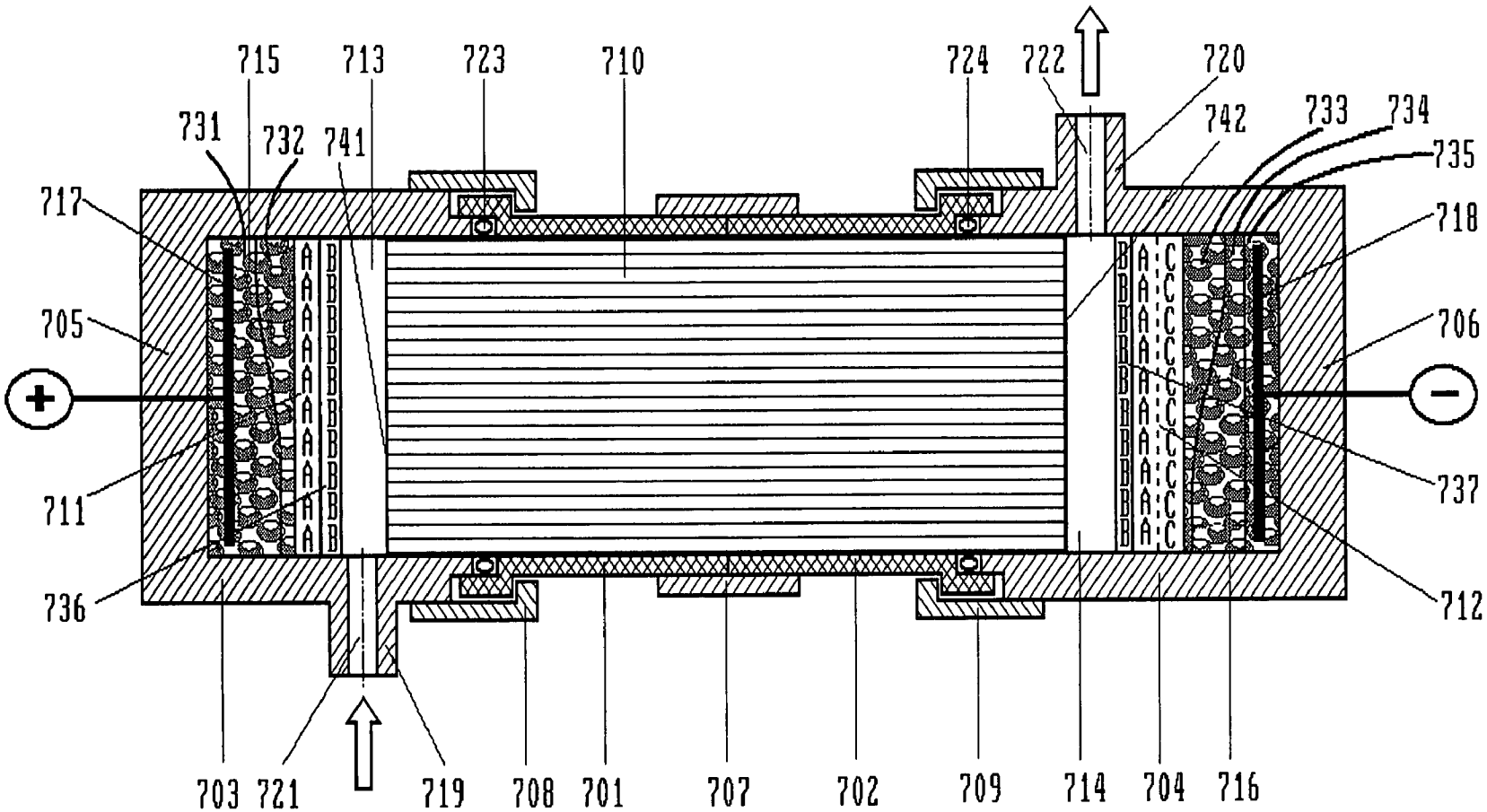
FIG. 7 shows the embodiment of the electrokinetic micropump according to FIG. 6, further comprising baromembranes for nanofiltration or reverse osmosis.

The electrokinetic micropump shown in cross section in FIG. 7 is similar to the micropump shown in FIG. 6, except for baromembranes 727, 728 for nanofiltration or reverse osmosis being installed near the ion-exchange membranes 711, 712. These baromembranes are located on the side of ion-exchange membranes that faces the corresponding end of the piece of polycapillary column 710.

Beside those mentioned, in FIG. 7 the following reference numbers are used:

701, 702—tubular parts of the housing;
703, 704—anodic resp. cathodic section;
705, 706—end walls of the anodic and the cathodic section;
707—sleeve for connection of the tubular parts of the housing;
708, 709—coupling nuts for connection of the tubular parts of the housing with the anodic and the cathodic section;
713, 714—chambers for flow of the pumped liquid;
715, 716—chambers filled with auxiliary medium for transfer of electric charges;
717, 718—anodic resp. cathodic electrode;
719, 720—nipples (inlet resp. outlet);
721, 722—openings of the nipples for inlet resp. outlet of the pumped liquid;
723, 724—annular sealing pads;
731, 732 and 733, 734, 735—layers of granulated ion-exchange material in the chambers that are filled with the auxiliary medium for transfer of electric charges in the anodic resp. the cathodic section, similar to the corresponding layers shown in FIG. 6, as described above;
741, 742—inlet resp. outlet end of the multichannel structure.

Figure 8:
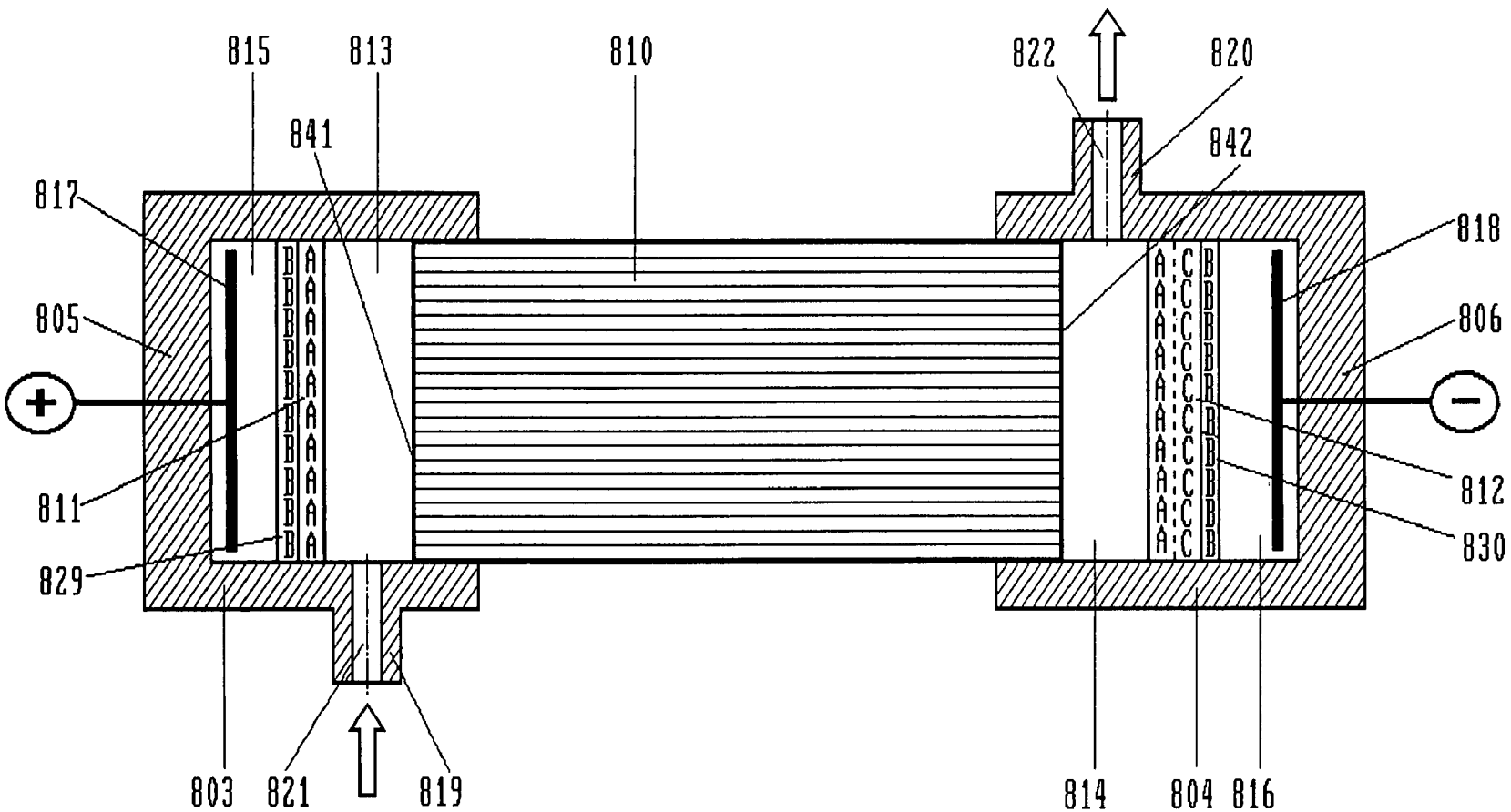
FIG. 8 shows an embodiment of a micropump without a housing, the micropump having a multichannel structure in the form of a piece of a polycapillary column.

The micropump according to the invention can also be made as shown in FIG. 8, differing from the embodiments according to the preceding Figures by the absence of a housing as a carrying structure of the micropump. In this embodiment the anodic 803 and the cathodic 804 section are fixed directly to the piece of polycapillary column 810 near its inlet 841 and outlet 842 ends (for example, they may be glued to them). For better mechanical strength the polycapillary column may be provided with a protective coating by a method that is described, for example, in patents [11], [12]. In this case the polycapillary column does not necessarily have to be circular in cross section, neither must the anodic and the cathodic section be cylindrical. Except for the absence of a housing and of elements for connection of the parts of the housing to one another and to the electrode sections, the micropump according to FIG. 8 is similar to the micropump according to FIG. 4. Also the micropumps according to FIG. 1-FIG. 3 and FIG. 5-FIG. 7 may be made with a similar construction.

Beside those specified above, in FIG. 8 the following reference numbers are used:

805, 806—end walls of the anodic and the cathodic section;
811, 812—anionite resp. bipolar ion-exchange membrane;
813, 814—chambers for flow of the pumped liquid;
815, 816—chambers filled with auxiliary medium for transfer of electric charges;
817, 818—anodic resp. cathodic electrodes;
819, 820—nipples (inlet resp. outlet);
821, 822—openings of the nipples for inlet resp. outlet of the pumped liquid;
829, 830—baromembranes for nanofiltration or reverse osmosis;
841, 842—inlet resp. outlet end of multichannel structure (piece of polycapillary column).

The electrokinetic micropump according to FIG. 1 operates as follows.

Figure 9:
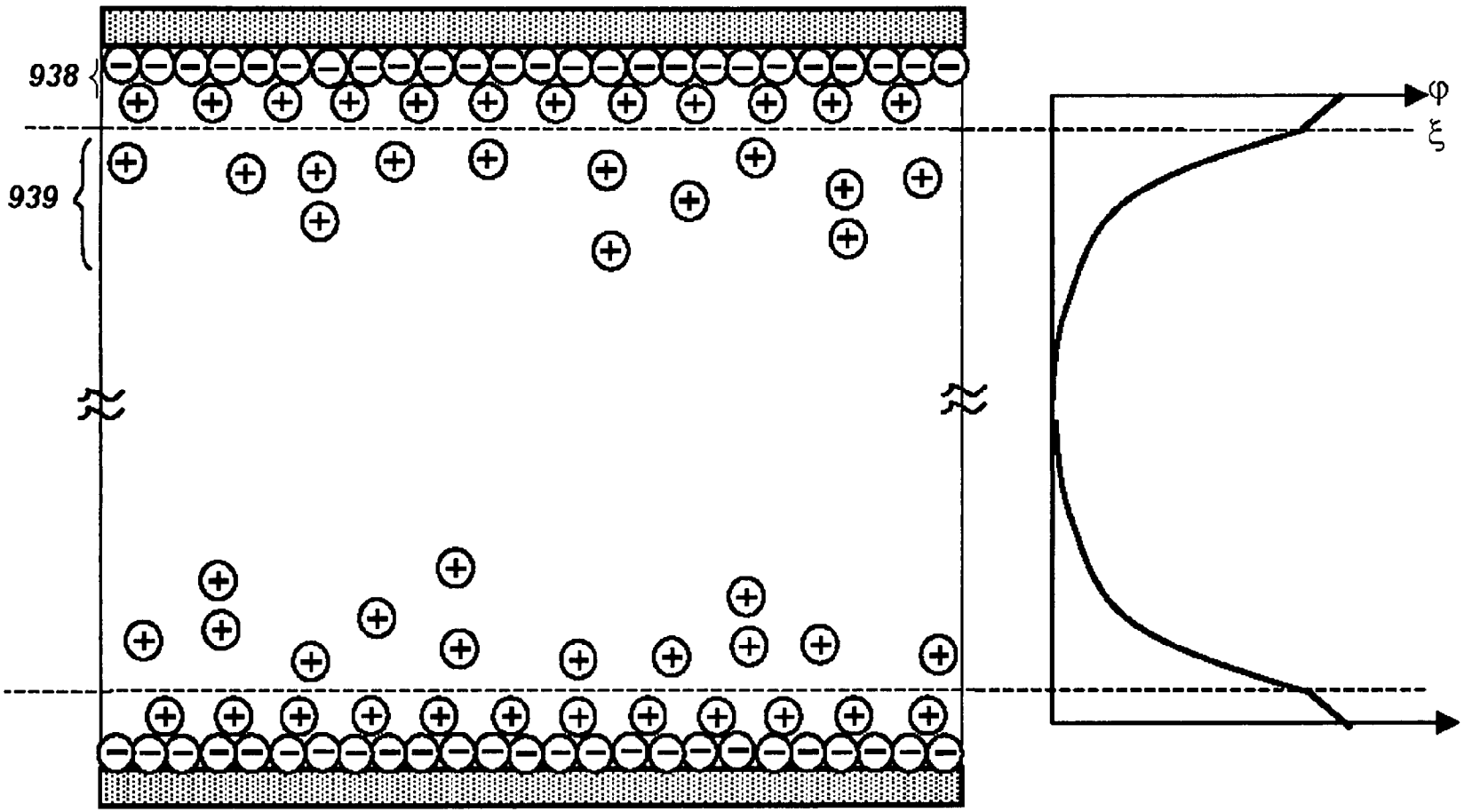
FIG. 9 shows a diagram of an electric double layer that forms within the microchannels of the multichannel structure.

When glass or quartz of which the multichannel structure is made of in the form of a piece of a polycapillary column 110 come in contact with water or an aqueous solution in each of the microchannels of the multichannel structure a electric double layer forms at the solid-liquid interface (i.e., at the wall of the microchannel). A diagram of this electric double layer is shown in FIG. 9. Under the conditions specified the inner surface of the solid usually carries an excess negative charge which is the result of its active centers adsorbing $OH^-$-ions or other anions from the solution and/or of desorbing $H^+$-ions or other cations into the solution. Excess negative charges at solid surface are neutralized with positive ions, for example, with protons from the solution or the solid. A part of said protons that belongs to the so called Stern layer is strongly adsorbed and may not be translocated by the liquid movement inside the microchannel. The positive potential of the Stern layer at the surface of the solid body is designated in FIG. 9 by $\phi$. This layer together with a layer of negative charges at the surface of the solid body forms the inner part 938 of the electric double layer. The rest of the protons that is required to neutralize the excess negative charge forms a diffuse layer, or Debye layer, i.e., the external part 939 of the electric double layer. Practically the total amount of protons (and other positively charged ions from the solution) belonging to the diffuse layer may be translocated by the liquid that is moving inside the microchannel. The potential on the slipping boundary between the moving part and the immobile part of the electric double layer (the so called zeta-potential) is designated in FIG. 9 by ξ. The values of the potentials beyond the electric double layer are zero, i.e., the rest of the liquid inside the microchannel remains electrically neutral with the numbers of negative and positive charges being equal to one another. These cations and anions are not shown in FIG. 9.

Consequently, if we consider only the moving part of the liquid inside the microchannel (i.e., only the liquid inside the slipping boundaries), then the liquid will have, as demonstrated in FIG. 9, an excess positive electric charge that is concentrated mainly near the inner walls of the microchannel. Under the action of the difference of electric potentials between the ends of the multichannel structure cations move towards the cathodic electrode 118, and anions move towards the anodic electrode 117. At the electrodes occurs the discharge of protons with release of gaseous hydrogen, and an equivalent discharge of hydroxyl-ions with release of gaseous oxygen, according to the following half-reactions:

on the cathodic electrode:

$$4H^{+}+4e \rightarrow 2H_2\uparrow,$$

on the anodic electrode:

$$4OH^{-}-4e \rightarrow O_2\uparrow+2H_2O.$$

Taking into consideration dissociation of water: $4H_2O=4OH^{-}+4H^{+}$.

The total process is:

$$2H_2O=2H_2\uparrow+O_2\uparrow.$$

It is obvious that anions and cations are transferred in opposite directions in equivalent quantities. However, the distribution of the transferred ions inside the microchannel is nonuniform. The electric double layer and the excess positive charge inside the slipping boundaries are always constant (under the influence of the external longitudinal field the instantaneous picture differs only in the diffuse part of the double layer being shifted by a distance that is comparable with molecular dimensions towards the cathodic electrode 118). This means that near the walls a transfer predominantly of cations occurs. Due to friction forces the hydrated cations that are being transferred carry away also free water molecules, which results in displacement of total water mass adjacent to the walls towards the cathodic electrode. In the central part of the microchannel the situation should be to the contrary. However, the transverse dimensions of the diffuse part of the double layer are so small in comparison to the diameter of the microchannel that the density of excess negative charges that are transferred towards the anodic electrode 117 is negligible, and there is no resultant displacement of comparable water masses towards the anodic electrode.

During the operation of the device shown in FIG. 1 the following processes take place:

1) transfer of anions (for example, $OH^{-}$) in chamber 115 for auxiliary medium towards the anodic electrode 117;

2) transfer of anions through the anion-exchange membrane 111;

3) discharge of $OH^{-}$-ions on the anodic electrode 117 with release of gaseous oxygen;

4) transfer of cations (for example, $H^{+}$) in chamber 116 for auxiliary medium towards the cathodic electrode 118;

5) generation of an equivalent quantity of $OH^{-}$-ions by the anionite side of the bipolar membrane 112 and their transfer towards the anodic electrode 117;

6) neutralization reaction between protons that are carried out of the multichannel structure 110, and hydroxyl ions that are generated by the bipolar membrane 112: $H^{+}+OH^{-}=H_2O$;

7) generation of an equivalent quantity of $H^{+}$-ions by the cationite side of the bipolar membrane 112 and their transfer to the cathodic electrode 118;

8) discharge of protons on the cathodic electrode 118 with release of gaseous hydrogen.

Therefore, during the operation of the electrokinetic micropump shown in FIG. 1 occurs pumping of a liquid (water or an aqueous solution) as well as decomposition of a small part of transferred water molecules on the electrodes with release of oxygen and hydrogen in quantities equivalent to the amount of transferred electric charges, according to Faraday's law.

The characterizing features of the operation of the device consist in the following:

- the cathodic and the anodic electrode are not in direct contact with the pumped liquid;
- the water content in the aqueous solution remains constant;
- air bubbles occurring during discharge on the electrodes can not get into the chambers for flow of the pumped liquid because the chambers are isolated with membranes.

If the electrodes were not separated from the ends 141, 142 of the multichannel structure by means of the anion-exchange membrane and the bipolar membrane, the following effects would take place: formation of air bubbles; blocking of the pumping or disturbance of the steadiness of the pumping process by the air bubbles; oxidation or reduction of components of the aqueous solution on the electrodes and, as a consequence, acidification or alkalinization of the pumped solution.

Figure 10:
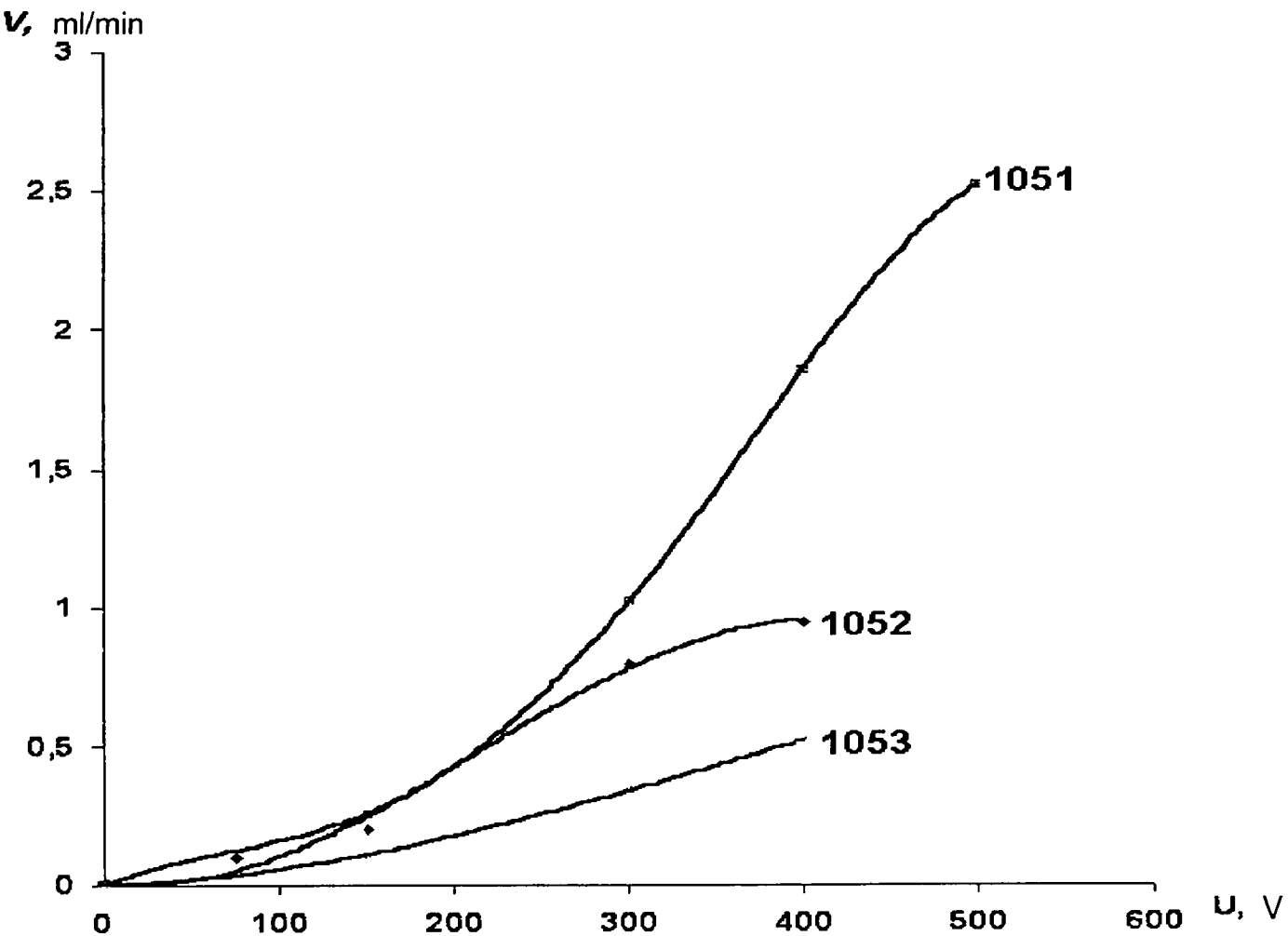
FIG. 10 shows a curve of the pumping rate of different liquids vs. DC current on the electrodes of the micropump according to FIG. 1.

FIG. 10 shows the dependency of the pumping rate of distilled water (curve 1051), as well as sodium chloride solutions of different concentration (30 mg/l—curve 1052 and 50 mg/l—curve 1053) on the DC voltage on the electrodes of the micropump according to FIG. 1. The length of the multichannel structure (the piece of a polycapillary column) is 30 mm, its outer diameter is 10 mm, the diameter of the individual channels is 10 microns, and the number of channels is 400, 000. The Figure shows that an increase in concentration of dissolved salts leads to a decrease in pumping rate of the liquid. This is due to the fact that with an increasing concentration of salts an increasing fraction of electric current is transferred by ions that do not participate in the formation of the electric double layer that is the cause of liquid pumping in the micropump.

The electrokinetic micropump according to the embodiment shown in FIG. 2 operates similarly to the above-described micropump, however, liquid pumping takes place in direction from the cathodic section 204 to the anodic section 203. This micropump corresponds to the case where the charges of all layers are opposite in sign to those shown in FIG. 9. This is possible, for example, when water or aqueous solutions contact the surfaces of a multichannel structure made of such plastic materials as polyamides or polyimines.

The electrokinetic micropump according to FIG. 3 operates completely similarly to the micropump shown in FIG. 1, however, the baromembranes 327, 328 used in this device prevent or substantially decrease transfer of any other anions beside hydroxyl ions to the anion-exchange membrane 311 and further to the anodic electrode 317, and the transfer of any cations beside protons to the bipolar membrane 312 and the cathodic electrode 318. The special feature of the functioning of this micropump consists in the possibility of maintaining a high pumping velocity of liquids in the form of concentrated salt solutions, as well as the prevention of discharge of other cations or anions than hydroxonium and hydroxyl on the electrodes.

This allows to avoid changes of pH value of the medium in the anodic and/or cathodic section, namely, in chambers 313 and 314 for the pumped liquid.

The special feature of the electrokinetic micropump according to FIG. 4 consists in that no gaseous products are formed in the process of operation of the micropump. The anodic section 403 and the cathodic section 404 are hermetic, and chambers 415, 416 that are filled with an auxiliary medium for transfer of electric charges contain as such medium a solution or suspension or paste of a mixture of substances that contains at least one chemical element at different oxidation levels. For example, a mixture of soluble iron salts with oxidation levels (II), (III) may be used as auxiliary medium for transfer of electric charges. In particular, when using a mixture of Fe(II) and Fe(III) sulfates, oxygen and hydrogen do not manage to be liberated at the electrodes. At lower absolute values of electrochemical potentials the following electrochemical oxidation and reduction processes take place:

at the cathodic electrode (reduction process):

$$Fe_2(SO_4)_3+2H^++2e \Rightarrow 2FeSO_4+H_2SO_4,$$

at the anodic electrode (oxidation process):

$$2FeSO_4+H_2SO_4+20H^--2e \Rightarrow Fe_2(SO_4)_3+2H_2O.$$

The result of the operation of said electrokinetic micropump, besides pumping of the liquid, consists in that the auxiliary medium for transfer of electric charges is enriched with a ferrous iron compound in the cathodic section, and with a ferric iron compound in the anodic section.

As auxiliary medium for transfer of electric charges may also be used, for example, a suspension of a mixture of manganese compounds with oxidation levels (IV), (VI) and (VII). In particular, when using a mixture of potassium permanganate, potassium manganate and manganese dioxide the following electrochemical oxidation and reduction processes take place at the electrodes:

at the cathodic electrode (reduction process):

$$2KMnO_4+4H^++4e \Rightarrow K_2MnO_4+MnO_2+2H_2O,$$

at the anodic electrode (oxidation process):

$$K_2MnO_4+MnO_2+4OH^--4e= \Rightarrow 2KMnO_4+2H_2O.$$

The result of the operation of the electrokinetic micropump, besides the pumping of liquid, consists in the enrichment of the auxiliary medium for transfer of electric charges in chamber 416 of the cathodic section with compounds of manganese at oxidation levels IV and VI, and in chamber 415 of the anodic section with the manganese compound at oxidation level VII.

In all variants of operation of the micropump according to FIG. 4, the baromembranes 429, 430 prevent contamination of the ion-exchange membranes 411, 412 with components of the auxiliary medium for transfer of electric charges.

After expiration of certain time period corresponding to one working cycle of the micropump, namely, after exhaustion of manganese compounds in reduced form (at oxidation levels IV and VI) in the anodic section, and simultaneous equivalent exhaustion of manganese compounds in oxidized form (at oxidation level VII) in the cathodic section, micropump stops to operate.

To restore its operating capacity, it is sufficient to exchange the chambers of the anodic and the cathodic section filled with auxiliary medium for transfer of electric charges with one another. In order to make such exchange possible, the anodic and cathodic electrode sections are made removable with provisions made for detachment of the chambers filled with auxiliary liquid for transfer of electric charges. The duration of one working cycle (between exchanges of the two chambers for the auxiliary medium) is determined by the quantity of active components in the auxiliary medium for transfer of electric charges (volume and concentration of these components).

Figure 11:
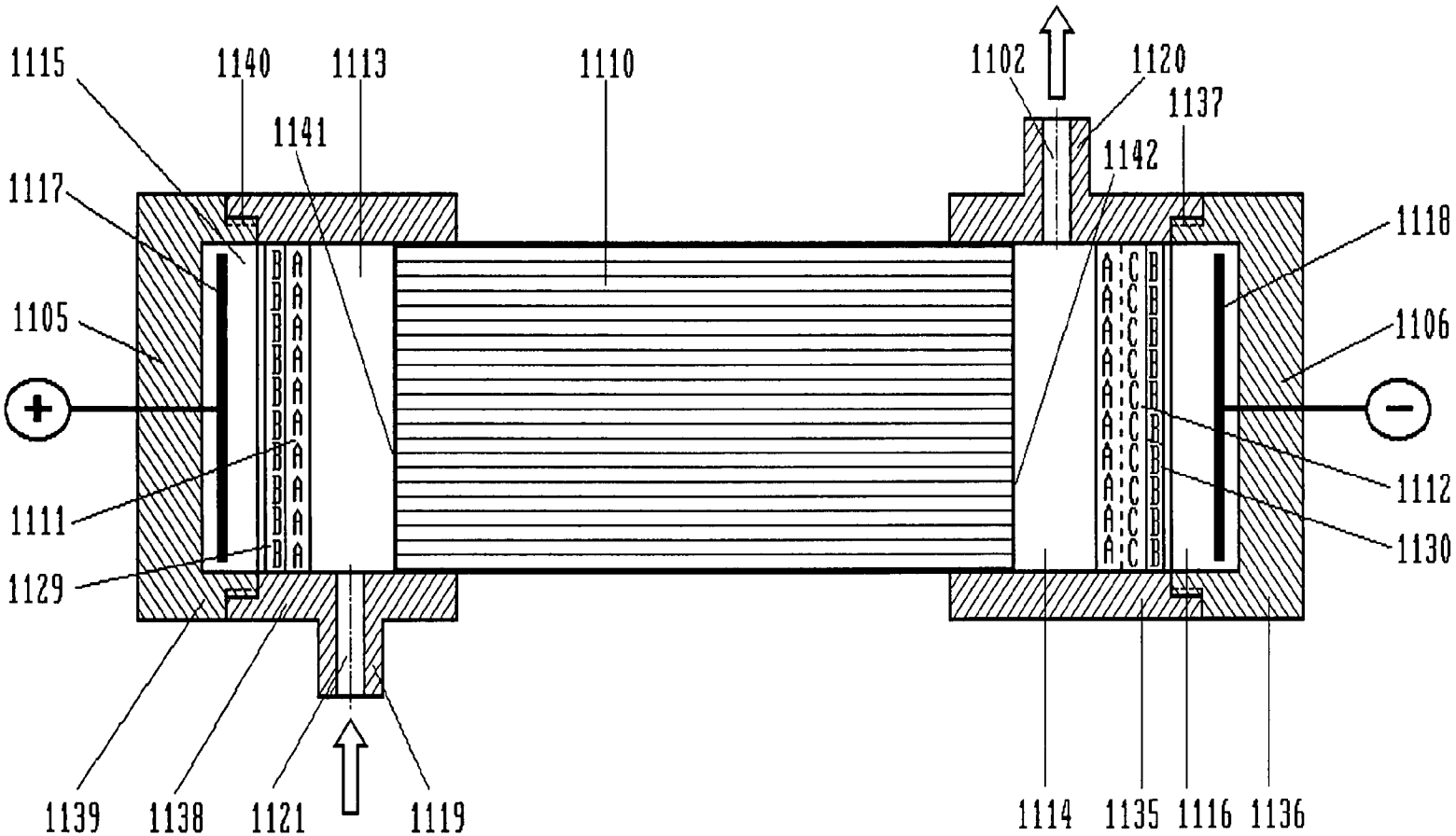
FIG. 11 shows an embodiment of the micropump with separable electrode sections.

An example of a micropump with such an embodiment of the electrode chambers is shown in FIG. 11. This micropump, similar to that shown in FIG. 8, is made without a housing. Parts 1135 and 1136 of the cathodic section, corresponding to chamber 1114 for flow of the pumped liquid and chamber 1116 for the auxiliary medium, are made with a threaded connection 1137. To ensure hermeticity, this connection may be provided with a suitable sealing (not shown in the drawing). Detachment of parts of the cathodic section may be performed by simple unscrewing of part 1136 of this section containing the chamber 1116 for the auxiliary medium and the cathodic electrode 1118 (part 1136 is the right part of the cathodic section according to FIG. 11). Doing so, the bipolar membrane 1112 and the baromembrane 1130 remain in the left part 1135 (according to FIG. 11) of the cathodic section containing chamber 1114 for flow of the pumped liquid. The parts 1138, 1139 of the anodic section and the threaded connection 1140 have analogous design and function. When the anodic section is separated the anionite membrane 1111 and the baromembrane 1129 remain in the right, (according to FIG. 11) part 1138 of the anodic section containing the chamber 1113 for flow of the pumped liquid. So, when exchanging chambers 1115, 1116 with the auxiliary medium after separation of parts 1138 and 1139 resp. 1135 and 1136, the ion-exchange membranes 1111, 1112 remain in place. Also the baromembranes 1129, 1130 remain in their original places.

Beside those mentioned above, in FIG. 11 the following reference numbers are used:

- 1105, 1106—end walls of anodic and cathodic section;
- 1110—multichannel structure in the form of a piece of a polycapillary column;
- 1117—anodic electrode;
- 1119, 1120—nipples (inlet resp. outlet);
- 1121, 1122—openings of nipples for inlet resp. outlet of the pumped liquid;
- 1141, 1142—inlet resp. outlet end of the multichannel structure (piece of a polycapillary column).

Figure 12:
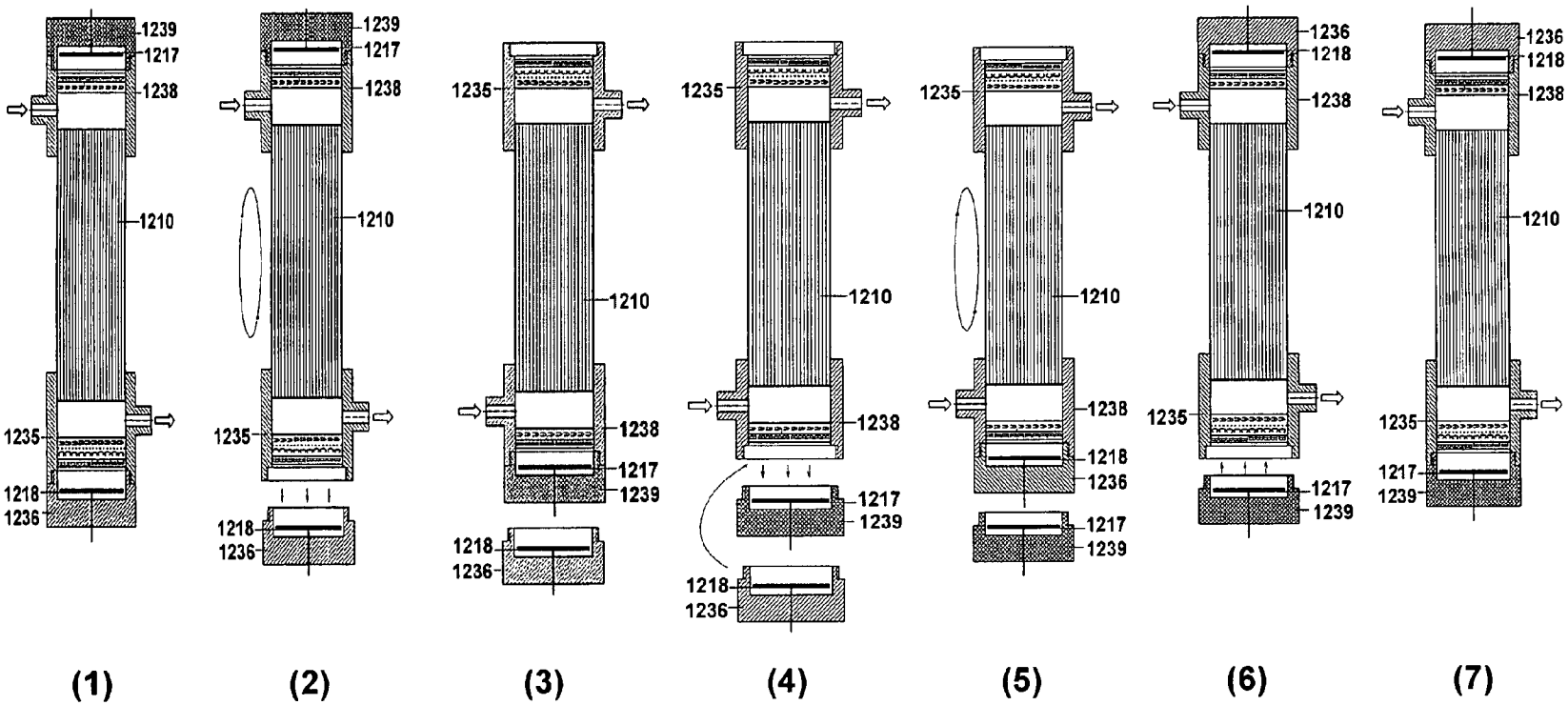
FIG. 12 illustrates the process of replacing the chambers for the auxiliary medium after completion of the working cycle of the micropump according to FIG. 11.

The stages of exchanging the chambers for the auxiliary medium are shown schematically in FIG. 12, where the following reference numbers are used:

- 1210—multichannel structure in the form of a piece of a polycapillary column;
- 1217, 1218—electrodes which before exchanging the chambers are anodic resp. cathodic, and after exchanging the chambers are cathodic resp. anodic;
- 1235, 1236—two parts of the cathodic section (before exchange of the chambers), the first comprising the chamber for flow of the pumped liquid and the second comprising the chamber with the auxiliary medium for transfer of electric charges;

1238, 1239—two parts of the anodic section (before exchange of the chambers), the first comprising the chamber for flow of the pumped liquid and the second comprising the chamber with auxiliary medium for transfer of electric charges.

The parts 1236 and 1239 of the cathodic resp. anodic sections that are to be exchanged are drawn in FIG. 12 with different hatchings.

Stages (1)-(7) of the exchange process consist in the following:

(1)—micropump is placed in an upright position, is disconnected from the external current source and from the source and the consumer of the pumped liquid (the latter is not necessary in the case of flexible connecting hoses of sufficient length);

(2)—part 1236 that is depicted below on the drawing and that comprises the chamber with the auxiliary medium and the electrode 1218 is detached, as shown by straight arrows; the circular arrow indicates that micropump may be turned upside down (see next stage);

(3)—the micropump with part 1236 being separated is turned upside down so that parts 1238 and 1239 are both located below;

(4)—part 1239 that is depicted below on the drawing and comprises the chamber with the auxiliary medium and the electrode 1217 is detached as shown by straight arrows; the arched arrow indicates that part 1236 may be connected with part 1238, i.e., mounted in place of part 1239 (see next stage);

(5)—part 1236 comprising the chamber with the auxiliary medium and the electrode 1218 is connected with part 1238, i.e., mounted in place of part 1239; the circular arrow indicates that the micropump may be turned over (see next stage);

(6)—the micropump with part 1236 connected to it is turned over in such a way that this part comes on top; the straight arrows indicate that part 1239 may be connected with part 1235 (see next stage);

(7)—part 1239 comprising the chamber with the auxiliary medium and the electrode 1217 is connected with part 1235, i.e., mounted in place of part 1236.

Thus, as a result of the operations according to the above steps, parts 1236 and 1239, each comprising a chamber with auxiliary medium and an electrode, are exchanged. The micropump may then again be connected to the external current source and to the source and the consumer of the pumped liquid (if they were disconnected). Thereby the same channels for inlet and outlet of the pumped liquid can be used as before, which is indicated by correspondingly orientated arrows. So, the positive pole of said source should be connected to the electrode 1218 which is shown above in the drawing, and the negative pole should be connected to the electrode 1217 which is shown below in the drawing, i.e., after exchange of the chambers also the electrodes change places and reverse their roles: electrode 1217, which previously was anodic, becomes cathodic, and former cathodic electrode 1218 becomes anodic.

The electrokinetic micropump according to FIG. 5 operates similarly to the micropump shown in FIG. 4, however, additional baromembranes 527, 528 used in this device prevent or substantially diminish the transfer of any anions besides hydroxyl ions from the pumped liquid towards anion-exchange membrane 511 and any cations besides protons towards the bipolar membrane 512. The special feature of operation of this micropump consists in the possibility of maintaining high pumping rates of liquids in the form of concentrated salts solutions.

The electrokinetic micropump according to FIG. 6 has the following operational features. Instead of formation of gaseous products solution of the material of the anodic electrode 617 takes place with formation of a metal ion that reacts with the cationite in hydrogen form that is filled in the hermetic chamber 615 for the auxiliary medium. Simultaneously, a transfer of metal ion takes place from the cationite filled in the hermetic chamber 616 for the auxiliary medium into the solution and its subsequent deposition on the cathodic electrode 618.

During operation of the micropump shown in FIG. 6 in which the anodic electrode 617 and the cathodic electrod 618 are made of metal copper, cationite in hydrogen form is charged into chamber 615 for the auxiliary medium of the anodic section 603, and cationite partially in hydrogen and partially in copper form is charged into chamber 616 for the auxiliary medium of the cathodic section 604. In this micropump the following processes take place:

1) transfer of anions in the multichannel structure 610 (for example, $OH^-$) towards the anodic electrode;

2) transfer of hydroxyl ions through the anion-exchange membrane 611 into chamber 615 for the auxiliary medium;

3) solution of the copper anodic electrode 617 on exposure to the anodic potential according to the half-reaction: $Cu \rightarrow Cu^{2+}+2e$;

4) reaction of the resulting copper ions with cationite in H-form and formation of copper form of cationite according to the reaction: $Cu^{2+}+2R—H=R_2—Cu+2H^+$;

5) transfer of protons through the layer of cationite in H-form towards the cathodic electrode and their reaction with the hydroxyl ions that are transported through the anion-exchange membrane 611 (see above, item 2) according to the reaction: $H^++OH^-=H_2O$;

6) transfer of protons in the multichannel structure 610 towards the cathodic electrode 618;

7) generation of equivalent quantity of $OH^-$-ions by anionite side of bipolar membrane 612 and their transfer from cathodic section towards anodic electrode 617;

8) neutralization reaction between protons carried out of multichannel structure 610 and hydroxyl ions generated by bipolar membrane 612, according to the reaction: $H^++OH^-=H_2O$;

9) generation of an equivalent quantity of $H^+$-ions by the cationite side of the bipolar membrane 612 and their transfer to the cathode 618 through the layer of cationite in H-form that is placed in the chamber 614 for the auxiliary medium;

10) reaction of the hydrogen ions with the cationite in copper form according to the reaction: $R_2—Cu+2H^+=Cu^{2+}+2R—H$;

11) discharge of copper ions and their deposition on the cathodic electrode 618 according to half-reaction: $Cu^{2+}+2e \rightarrow Cu$.

Therefore, during the operation of the electrokinetic micropump shown in FIG. 6 the resultant effects comprise liquid pumping (water or aqueous solution), partial dissolution of the anodic electrode 617 and deposition of an equivalent quantity of copper on the cathodic electrode 618.

Upon expiration of a certain time period that corresponds to one working cycle of the micropump, namely, after the boundary between the layers 631 and 632 of the cationite in chamber 615 moves to the anion-exchange membrane 611, the micropump ceases to operate. In order to restore its operating capacity, the micropump chambers for the auxiliary medium of the anodic and the cathodic section should be exchanged, as has been described above and as illustrated in FIG. 11 and FIG. 12. The duration of one working cycle (between two exchanges of the chambers) is determined by the quantity of cationite charged into the chambers for the auxiliary medium of the anodic and the cathodic section.

In this case and all the above described cases the processes that take place after the exchange of the chambers is analogous the processes of the previous cycle.

Figure 13:
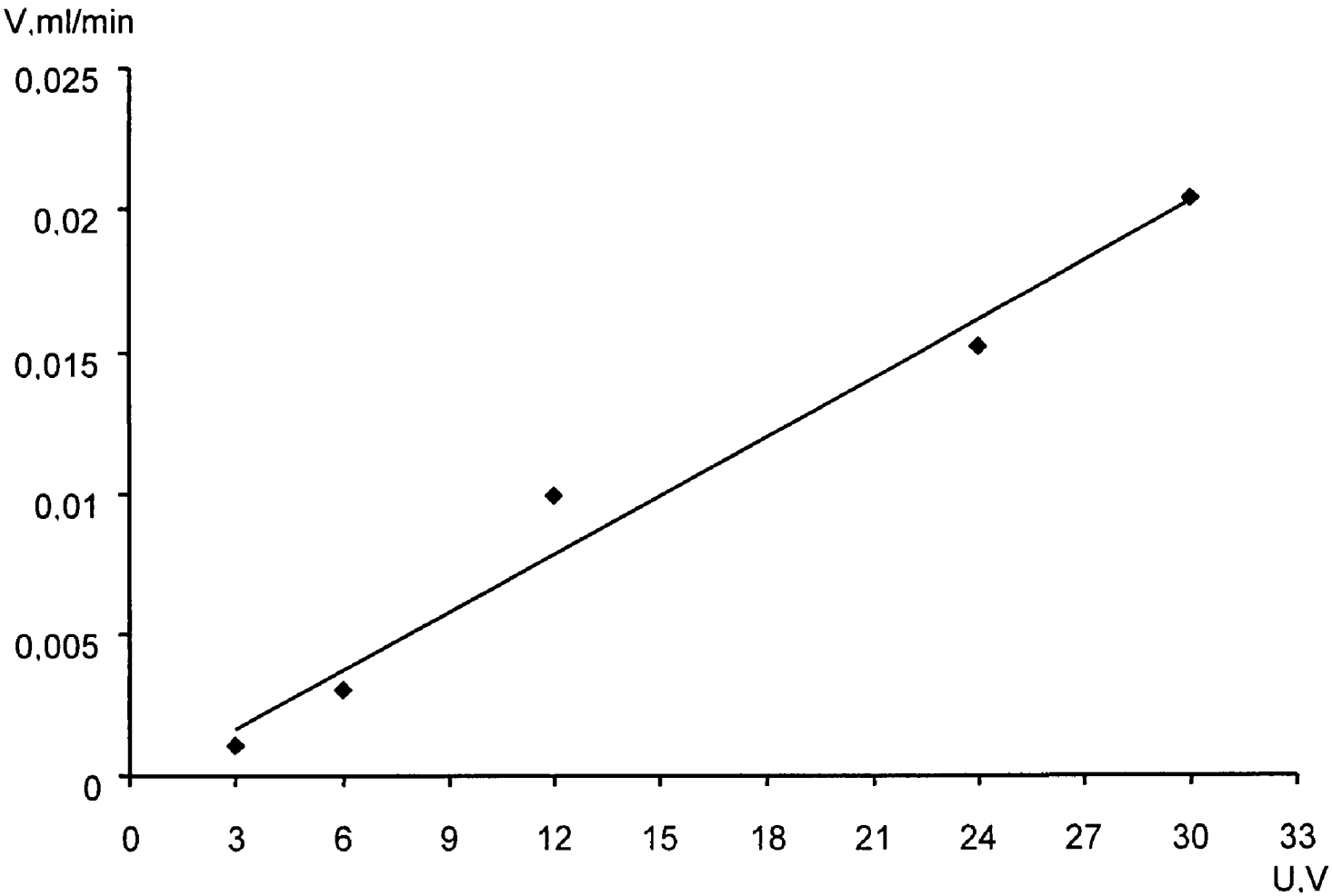
FIG. 13 shows a curve of the pumping rate of distilled water vs. the voltage at the electrodes of the micropump according to FIG. 6.

FIG. 13 shows the dependency of the pumping rate for distilled water on the DC voltage on the electrodes of the micropump according to FIG. 6. The length of the multichannel structure (the polycapillary column) is 30 mm, its outer diameter is 9.6 mm, the diameter of the individual channels is 10 microns, and the number of channels is 360,000. As can be seen, minimum controlled pumping rates in the order of 10 microliters/min can be reached.

The electrokinetic micropump shown in FIG. 7 operates similarly to the above described micropump according to FIG. 6. The only difference consists in higher pumping rates of concentrated solutions being achieved and in the prevention of components of the solution, beside hydroxonium and hydroxyl ions, reaching the ion-exchange membranes 711, 712. This is due to the fact that baromembranes 727, 728 for nanofiltration or reverse osmosis are arranged near the ion-exchange membranes on their side facing the corresponding ends 741, 742 of the piece of polycapillary column 710.

Figure 14:
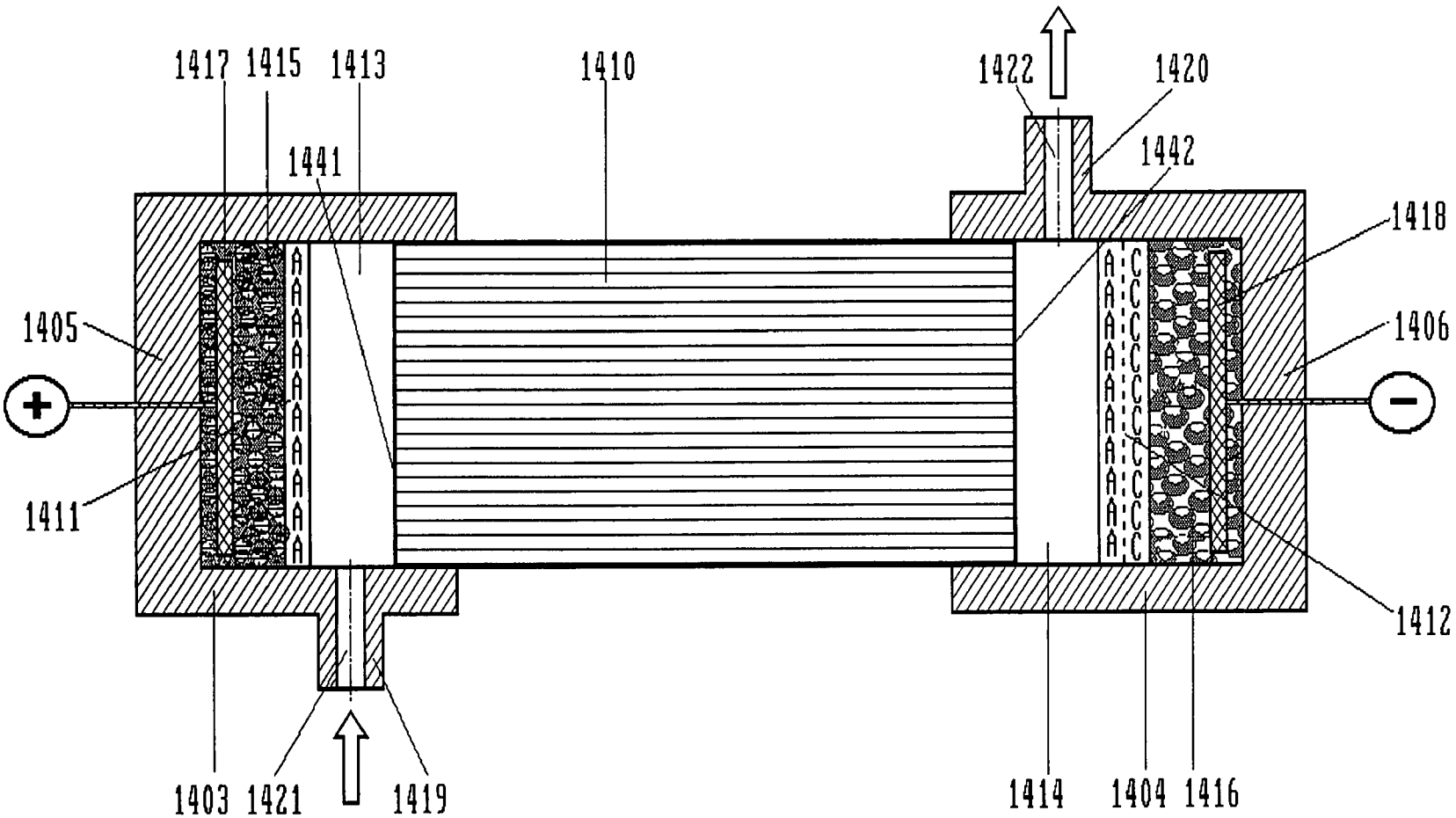
FIG. 14 shows an embodiment of the electrokinetic micropump having electrodes of the second order.

In all the above described particular embodiments of the electrical micropump of the present invention that are illustrated in FIG. 1-FIG. 8, the use of electrodes of the first order is not obligatory. It is also possible to use electrodes of the second order. FIG. 14 shows an embodiment of a micropump similar to that according to FIG. 6, but analogously to the micropump shown in FIG. 8 without housing, and equipped with silver-silver chloride anodic 1417 and cathodic 1418 electrodes.

The chamber 1415 for auxiliary medium of the anodic section 1403 is filled with a granulated ion-exchange material which represents a cationite, and the chamber 1416 of the cathodic section 1404 is filled with a ion-exchange material which represents an anionite.

Beside those mentioned above, in FIG. 14 the following reference numbers are used:

- 1405, 1406—end walls of the anodic and the cathodic section;
- 1410—multichannel structure in the form of a piece of a polycapillary column;
- 1411 and 1412—anionite resp. bipolar ion-exchange membranes, correspondingly;
- 1413, 1414—chambers for flow of the pumped liquid;
- 1419, 1420—nipples (inlet resp. outlet);
- 1421, 1422—openings of the nipples for inlet resp. outlet of the pumped liquid;
- 1441, 1442—inlet resp. outlet ends of the multichannel structure (the piece of polycapillary column).

During the operation of this micropump the following processes take place:

1) formation of silver ions on the anodic electrode 1417: $Ag\text{-}e \rightarrow Ag^+$;

2) release of silver ions from the silver-silver chloride electrode 1417 and their reaction with the anionite in chamber 1415 of the anodic section 1403:

$$R\text{–}H^+Ag^+ = R\text{–}Ag^+H^+;$$

3) transfer of hydroxy ions through the anion-exchange membrane 1411;

4) reaction of hydrogen ions formed in process 2 with hydroxyl ions, resulting in the formation of water: $H^+ + OH^- = H_2O$;

5) transfer of protons in the multichannel structure 1410 towards the cathodic electrode 1418;

6) generation of an equivalent quantity of $OH^-$ ions by the anionite side of the bipolar membrane 1412;

7) neutralization reaction between the protons that are carried out of the multichannel structure 1410, and the hydroxyl ions that are generated by the bipolar membrane 1412, according to the reaction: $H_2O = H^+ + OH^-$;

8) generation of an equivalent quantity of $H^+$ ions by the cationite side of the bipolar membrane 1412;

9) formation of chlorine ions on the cathodic electrode 1418:

$$AgCl + e = Ag^0 + Cl^-;$$

10) release of chlorine ions by the cathodic electrode;

11) reaction of hydrogen ions and chlorine ions with the anionite:

$$R\text{—}OH + H^+ + Cl^- = R\text{—}Cl + H_2O.$$

So, the effects during the operation of the electrokinetic micropump shown in FIG. 14 are as follows:

pumping of the liquid;

formation of cationite in $Ag^+$-form;

formation of anionite in $Cl^-$-form.

As can be seen, the processes that occur when using electrodes of the second order are not symmetrical. Therefore, after the exhaustion of the ionites it is not possible to exchange the chambers 1415, 1416 for the auxiliary medium of the anodic and the cathodic section, and, consequently, the anodic and the cathodic sections need not be made separable as according to FIG. 11. The drawback of the use of electrodes of the second order is also a lower allowable current density.

Figure 15:
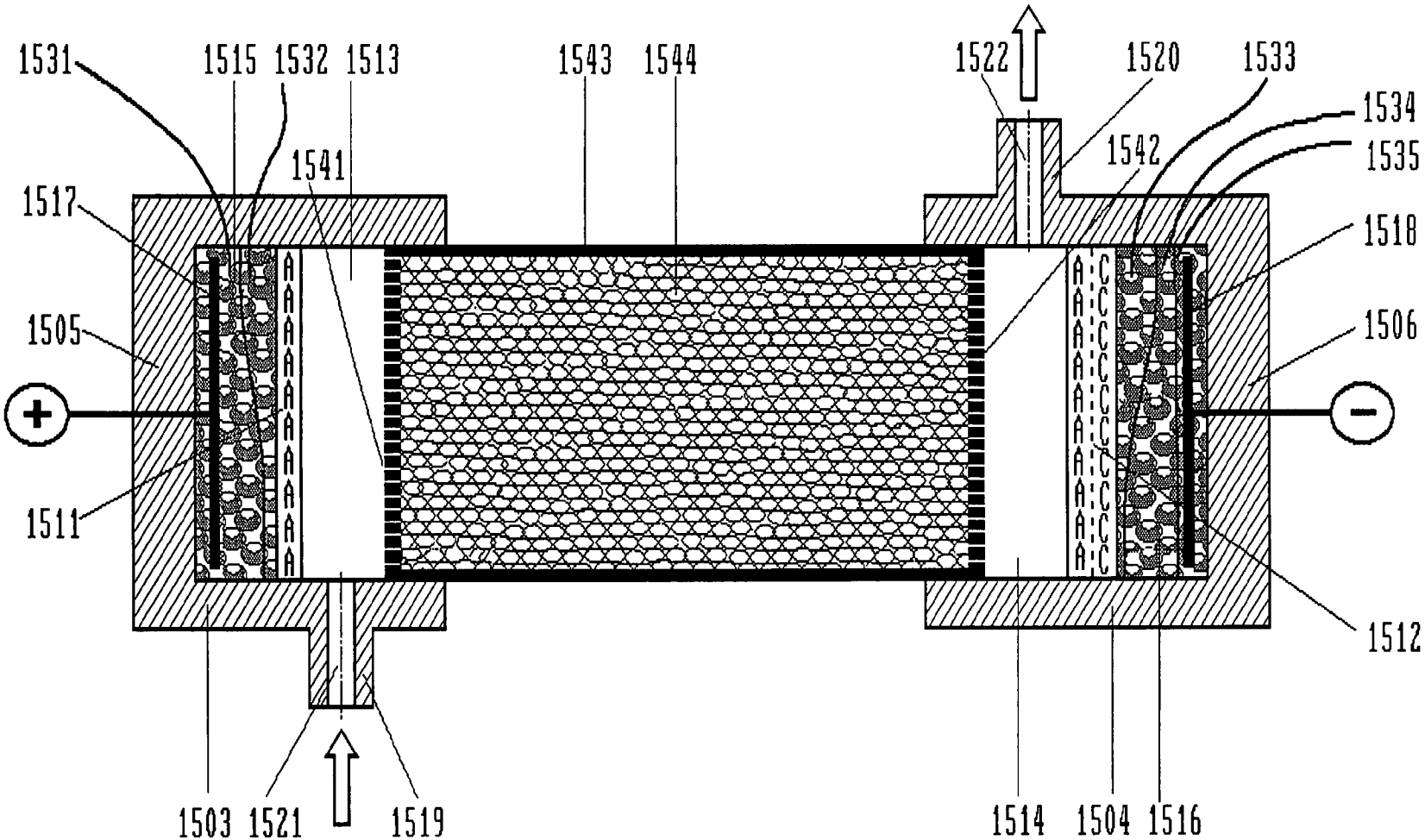
FIG. 15-FIG. 17 show embodiments of the electrokinetic micropump having a multichannel structure that does not represent a piece of a polycapillary column.
Figure 17:
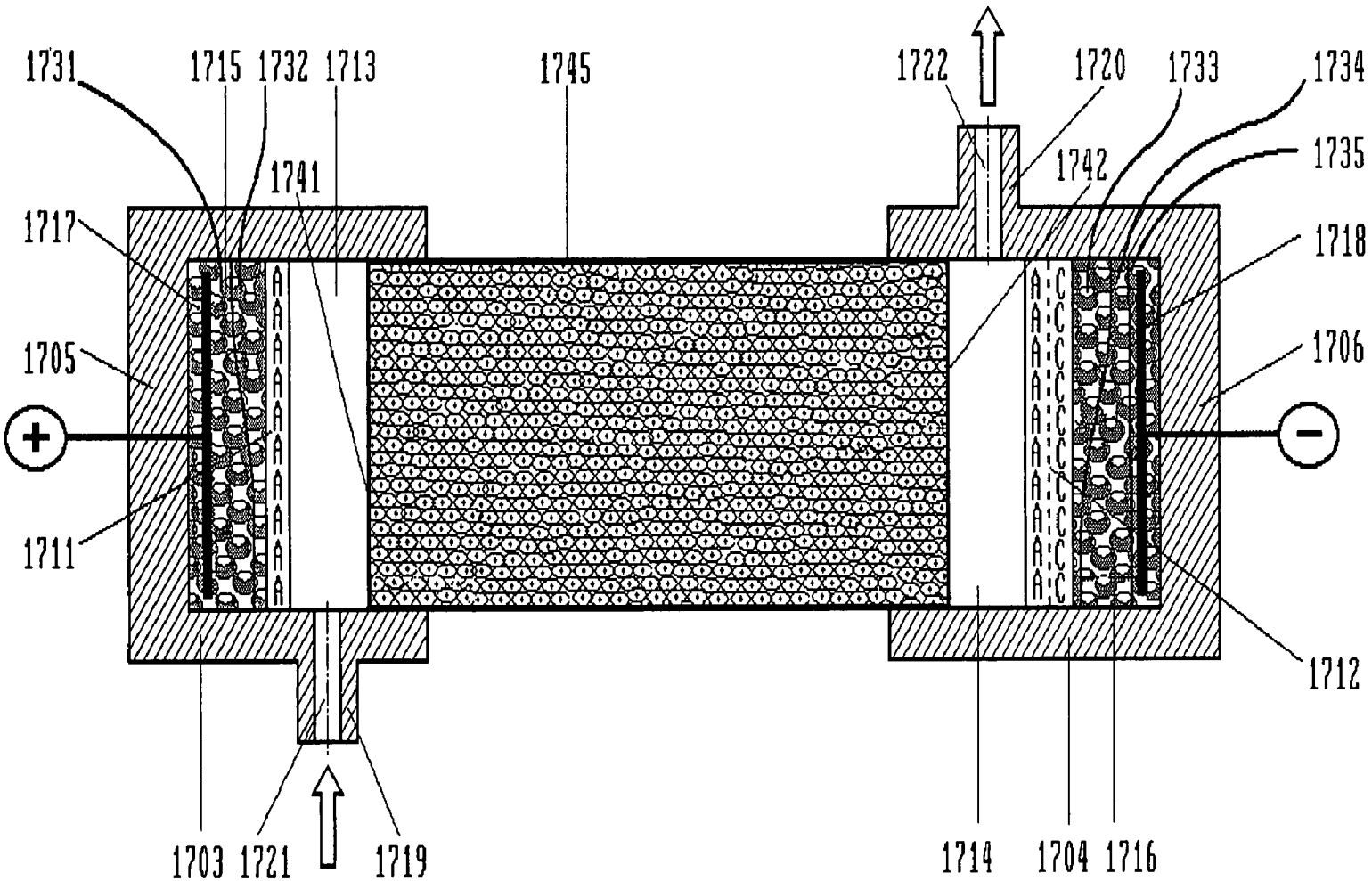

As noted above, the manufacture of the multichannel structure in the form of a piece of a polycapillary column is preferred, although not necessary. FIG. 15 and FIG. 17 show examples of micropumps in which the multichannel structure has made differently.

In the micropump according to FIG. 15 the multichannel structure is a container 1543 having end surfaces 1541, 1542 that are permeable for the pumped liquid, and being filled with powdered material 1544.

Figure 16:
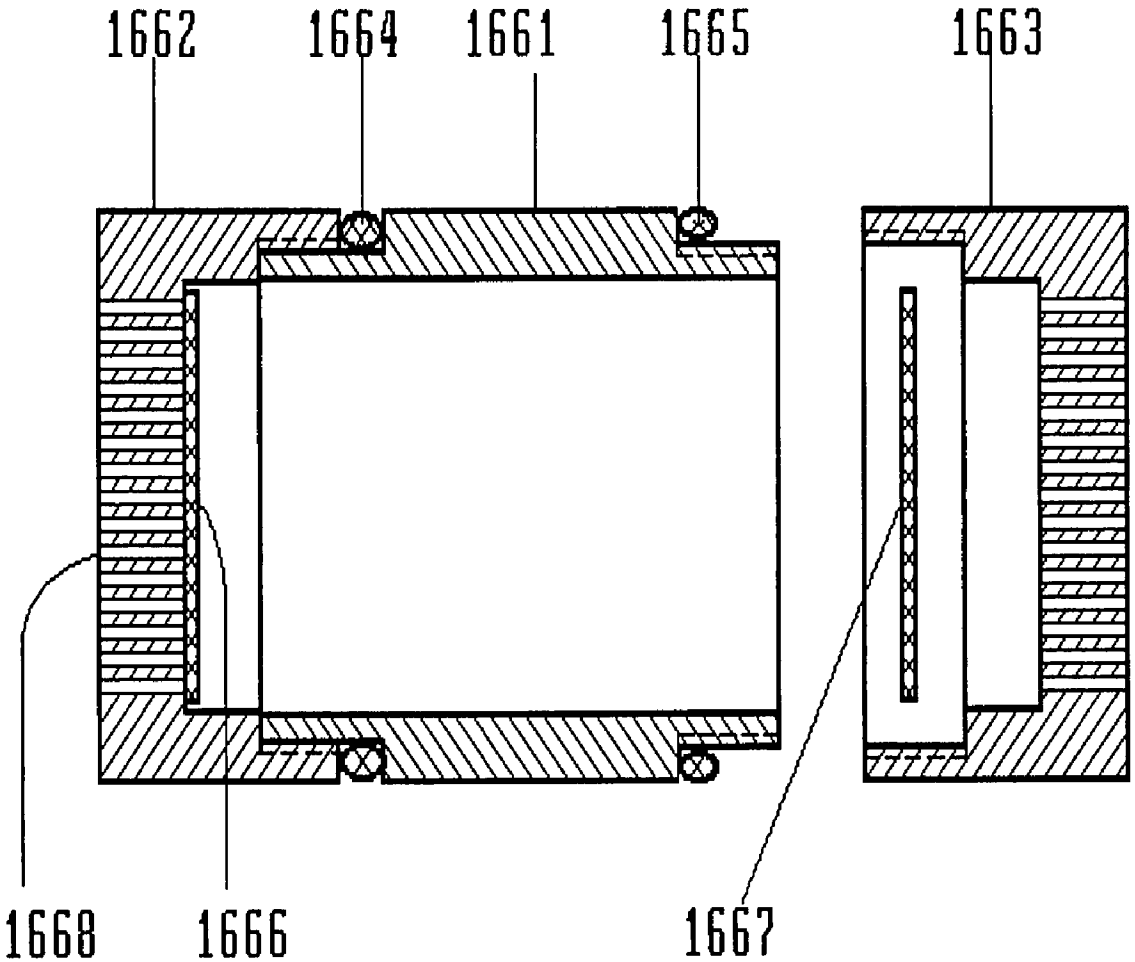

An embodiment of the container for the powdered material is shown in FIG. 16. The container is a hollow cylinder 1661 with removable covers 1662, 1663 (cover 1663 is shown in a detached position) that are hermetically screwed on the cylinder. Microfiltration membranes 1666, 1667 are arranged in the covers (membrane 1666 is shown in the position that it should occupy upon completion of the assembly of the container, and membrane 1667 is shown in an intermediate position). The end walls of covers 1662, 1663 which upon completion of the assembly of the container should tightly fit to the microfiltration membranes (as shown in FIG. 16 for membrane 1666), form the ends of the multichannel structure. In FIG. 15 they are designated as 1541, 1542, correspondingly. Rubber or silicone ring gaskets 1664, 1665 ensure the hermeticity of the container after its assembly. The hollow cylinder 1661 and the covers 1662, 1663 of the container are made of non-conducting material, preferably, plastic, for example, polypropylene, polyethylene, plexiglas, teflon, kaprolon, etc.

Holes 1668 of 0.5-1 mm in diameter are drilled evenly in the end walls of the container covers 1662, 1663. The required permeability of the microfiltration membranes 1666, 1667 depends on the particle size of the powder used. For example, for a particle size from over 5.5 to 10 microns it would be appropriate to use polyacetate membranes with 5 micron wide openings manufactured by Millipore.

The powdered material charged into the container 1543 (FIG. 15) is a non-conducting material of inorganic or organic nature (ceramics, glass, quartz, polyvinylchloride, polyacetate, etc.).

The multichannel structure in this case is assembled as follows:

one of the covers is screwed on the hollow cylinder 1661 (for example, cover 1662, as shown in FIG. 16);

one of the microfiltration membranes is placed at the bottom of obtained vessel (for example, membrane 1666, as shown in FIG. 16);

the obtained vessel is densely loaded with an aqueous suspension of the powdered material by giving a sediment to settle down and discharging excessive liquid;

the layer of wetted powder is covered with the second microfiltration membrane and the second cover is screwed on tightly.

In the micropump according to FIG. 17 the multichannel structure is a porous body 1745 obtained by sintering of powdered material. As such material silicate, aluminosilicate, phosphate, and titanate ceramics may be used, as well as ceramics containing mixtures of metal oxides.

The lateral surface of the porous body is covered with a layer of a polymerizable sealant, preferably on silicone basis.

In all other respects, the micropumps shown in FIG. 15 and FIG. 17 are analogous to that shown in FIG. 6 (except for the absence of a housing; in this respect they are analogous to the micropump shown in FIG. 8).

Beside those mentioned above, in FIG. 15 and FIG. 17 the following reference numbers are used:

1503, 1703 and 1504, 1704—anodic resp. cathodic section;

1505, 1705 and 1506, 1706—end walls of anodic resp. cathodic section;

1511, 1711 and 1512, 1712—anionite resp. bipolar ion-exchange membrane;

1513, 1514, 1713, 1714—chambers for flow of the pumped liquid;

1515, 1516, 1715, 1716—chambers filled with auxiliary medium for transfer of electric charges;

1517, 1717 and 1518, 1718—anodic resp. cathodic electrode;

1519, 1719 and 1520, 1720—nipples (inlet resp. outlet);

1521, 1721 and 1522, 1722—openings of nipples for inlet resp. outlet of the pumped liquid;

1531, 1532, 1731, 1732 and 1533, 1534, 1535, 1733, 1734, 1735—layers of granulated ion-exchange material in chambers filled with auxiliary medium for transfer of electric charges in the anodic resp. the cathodic section, analogous to the corresponding layers shown in FIG. 6 and described above;

1741 and 1742—inlet resp. outlet end of the multichannel structure.

In all particular embodiments of the electrokinetic micropump according to the invention, the external current source, to which the anodic and the cathodic electrode are connected, needs not necessarily be a DC source. It is sufficient to use a unipolar source, for example, a pulsating current source after single- or double-wave rectification of alternating current. It may be also a source of differently shaped pulses of constant polarity. Moreover, an acceptable source is also one having an output voltage of no constant polarity. It is only important that difference of potentials between the output poles of the source should have a DC component (average value over time) of a certain sign, and depending on this the poles are chosen for connection to the anodic and the cathodic electrode.

The electrokinetic micropump according to the invention may be used for the development of continuously acting microdispensers, i.e., miniature devices for controlled-rate pumping of liquids. It may be used in chemical and biological microanalysis, as well as for fine dosing of drugs for administration to animals and humans, in particular, according to a prescribed schedule.

PRIOR ART DOCUMENTS

1. A. Manz, C. S. Effenhauser, N. Burggraf, D. J. Harrison, K. Seiler, K. Fluri, Electroosmotic pumping and electrophoretic separations for miniaturized chemical analysis systems, J. Micromech. Microeng., 1994, V. 4, pp. 257-265.
2. Chuan-Hua Chen, Juan Santiago, A Planar Electroosmotic Micropump, J. Electromechanical Systems, 2002, V. 11. No. 6, pp. 672-683.
3. U.S. Pat. No. 6,770,183, published on Aug. 3, 2004.
4. Oliver Geschke, Henning Klank, Pieter Telleman, Microsystem Engineering of Lab-on-a-chip Devices, Willey-VCH Verlag GmbH & Co. KGaA, Weinheim, 2004, pp. 46-50.
5. U.S. Pat. No. 6,287,440, published on Sep. 11, 2001
6. M. Moini, P. Cao, A. J. Bard, Hydroquinone as a Buffer Additive for suppression of bubbles formed by Electrochemical oxidation, Anal. Chemistry, 1999, V. 71, pp. 1658-1661.
7. Y. Takamura, H. Onoda, H. Inokuchi, S. Adachi, A. Oki, Y. Horiike, Low-voltage electroosmosis pump for stand-alone microfluidic devices, Electrophoresis, 2003, 24, pp. 185-192.
8. U.S. Pat. No. 3,923,426, published on Dec. 2, 1975.
9. RU patent No. 2096353, published on Nov. 20, 1997.
10. DE patent No. 4411330, published on Aug. 14, 2003.
11. U.S. Pat. No. 3,923,426, published on Dec. 2, 1975
12. RU utility model No. 31859, published on Aug. 27, 2003.

The invention claimed is:

1. An electrokinetic micropump comprising a multichannel structure made of electrically non-conducting material and having end-to-end microchannels, the inlets and outlets of the microchannels forming the inlet end and the outlet end of the multichannel structure, each of these ends being adjacent to an electrode section, one of which contains an anodic electrode and the other a cathodic electrode, an ion-exchange membrane being mounted in each of said electrode sections between the electrode mounted therein and the end of the multichannel structure, characterized in that one of the ion-exchange membranes is monopolar, and the other is bipolar, with the type of the monopolar ion-exchange membrane corresponding to the polarity of the adjacent electrode, the bipolar ion-exchange membrane facing the adjacent electrode with its side that corresponds in polarity to said electrode, whereas the ion-exchange membranes divide each electrode section, in which they are arranged, into two chambers, said chambers being situated at one side of each of the ion-exchange membranes communicating with the end of the multichannel structure and being suitable for passing through the pumped liquid, and one of said chambers having an inlet opening for the pumped liquid and the other having an outlet opening for the pumped liquid, and the chambers being situated at the other side of each ion-exchange membrane contain said anodic and cathodic electrode and are suitable for being filled with an auxiliary medium for transfer of electric charges.

2. The micropump according to claim 1, characterized in that the anodic and cathodic electrode are electrodes of the first order.

3. The micropump according to claim 1, characterized in that it additionally comprises baromembranes for nanofiltration or reverse osmosis that are placed on one side or both sides of each of said bipolar and monopolar ionexchange membrane.

4. The micropump according to claim 1, characterized in that the multichannel structure is made in the form of a piece of a polycapillary column having end-to-end capillaries that form a plurality of parallel channels.

5. The micropump according to claim 4, characterized in that it comprises additionally baromembranes for nanofiltration or reverse osmosis, situated at one or both sides of each of said bipolar and monopolar ion-exchange membranes.

6. The micropump according to claim 1, characterized in that the chamber suitable for being filled with an auxiliary medium for transfer of electric charges contains as such medium a liquid identical with the pumped liquid.

7. Micropump according to claim 1, characterized in that the chamber suitable for being filled with an auxiliary medium for transfer of electric charges contains as such medium a solution, suspension or paste of a mixture of substances that contain at least one chemical element at different oxidation levels.

8. The micropump according to claim 1, characterized in that the chamber suitable for being filled with an auxiliary medium for transfer of electric charges contains as such medium a solution of, at least, one electrolyte containing an element that is comprised in the material of which the electrode is made that is located in said chamber.

9. The micropump according to claim 1, characterized in that the chamber suitable for being filled with an auxiliary medium for transfer of electric charges, contains as such medium a granulated ion-exchange material.

10. The micropump according to claim 2, characterized in that the chamber suitable for being filled with an auxiliary medium for transfer of electric charges contains as such medium a liquid identical with the pumped liquid.

11. The micropump according to claim 2, characterized in that the chamber suitable for being filled with an auxiliary medium for transfer of electric charges contains as such medium a solution, suspension or paste of a mixture of substances containing at least one chemical element at different oxidation levels.

12. The micropump according to claim 2, characterized in that the chamber suitable for being filled with an auxiliary medium for transfer of electric charges contains as such medium a solution of at least one electrolyte containing an element that is comprised in the material of which the electrode is made that is located in said chamber.

13. The micropump according to claim 2, characterized in that the chamber suitable for being filled with an auxiliary medium for transfer of electric charges contains as such medium a granulated ion-exchange material.

14. The micropump according to claim 3, characterized in that the chamber suitable for being filled with an auxiliary medium for transfer of electric charges contains as such medium a liquid identical with the pumped liquid.

15. The micropump according to claim 3, characterized in that the chamber suitable for being filled with an auxiliary medium for transfer of electric charges contains as such medium a solution, suspension or paste of a mixture of substances containing at least one chemical element at different oxidation levels.

16. The micropump according to claim 3, characterized in that the chamber suitable for being filled with an auxiliary medium for transfer of electric charges contains as such medium a solution of at least one electrolyte containing an element that is comprised in the material of which the electrode is made that is located in said chamber.

17. The micropump according to claim 3, characterized in that the chamber suitable for being filled with an auxiliary medium for transfer of electric charges contains as such medium a granulated ion-exchange material.

18. The micropump according to claim 4, characterized in that the chamber suitable for being filled with an auxiliary medium for transfer of electric charges contains as such medium a liquid identical with the pumped liquid.

19. The micropump according to claim 4, characterized in that the chamber suitable for being filled with an auxiliary medium for transfer of electric charges contains as such medium a solution, suspension or paste of a mixture of substances containing at least one chemical element at different oxidation levels.

20. The micropump according to claim 4, characterized in that the chamber suitable for being filled with an auxiliary medium for transfer of electric charges contains as such medium a solution of at least one electrolyte containing an element comprised in the material of which the electrode is made that is located in said chamber.

21. The micropump according to claim 4, characterized in that the chamber suitable for being filled with an auxiliary medium for transfer of electric charges contains as such medium a granulated ion exchange material.

22. The micropump according to claim 5, characterized in that the chamber suitable for being filled with an auxiliary medium for transfer of electric charges contains as such medium a liquid identical with the pumped liquid.

23. The micropump according to claim 5, characterized in that the chamber suitable for being filled with an auxiliary medium for transfer of electric charges contains as such medium a solution, suspension or paste of a mixture of substances containing at least one chemical element at different oxidation levels.

24. The micropump according to claim 5, characterized in that the chamber suitable for being filled with an auxiliary medium for transfer of electric charges contains as such medium a solution of at least one electrolyte containing an element comprised in the material of which the electrode is made that is located in said chamber.

25. The micropump according to claim 5, characterized in that the chamber suitable for being filled with an auxiliary medium for transfer of electric charges contains as such medium a granulated ion-exchange material.

26. The micropump according to claim 9, characterized in that the anodic electrode is made of a material that is soluble in said auxiliary medium under the action of a positive electric potential.

27. The micropump according to claim 26, characterized in that the cathodic electrode is made of a material on which components of said auxiliary medium deposit under the action of a negative electric potential.

28. The micropump according to claim 6, characterized in that the anodic electrode is made of material that is insoluble in said auxiliary medium under the action of a positive electric potential.

29. The micropump according to claim 8, characterized in that the cathodic electrode is made of a material on which components of said auxiliary medium deposit under the action of a negative electric potential.

30. The micropump according to claim 29, characterized in that the anodic electrode is made of a material that is insoluble in said auxiliary medium under the action of a positive electric potential.

31. The micropump according to claim 2, characterized in that it additionally comprises baromembranes for nanofiltration or reverse osmosis that are placed on one side or both sides of each of said bipolar and monopolar ionexchange membrane.

32. The micropump according to claim 2, characterized in that the multichannel structure is made in the form of a piece of a polycapillary column having end-to-end capillaries that form a plurality of parallel channels.

* * * * *